US009381444B2

(12) United States Patent
Grossman

(10) Patent No.: US 9,381,444 B2
(45) Date of Patent: Jul. 5, 2016

(54) HELICAL SPRING TOY AND METHOD OF USE THEREOF

(71) Applicant: Victor A. Grossman, Staten Island, NY (US)

(72) Inventor: Victor A. Grossman, Staten Island, NY (US)

( * ) Notice: Subject to any disclaimer, the term of this patent is extended or adjusted under 35 U.S.C. 154(b) by 10 days.

(21) Appl. No.: 13/766,778

(22) Filed: Feb. 14, 2013

(65) Prior Publication Data

US 2013/0303048 A1 Nov. 14, 2013

Related U.S. Application Data

(60) Provisional application No. 61/598,538, filed on Feb. 14, 2014.

(51) Int. Cl.

| | |
|---|---|
| ***A63H 33/00*** | (2006.01) |
| ***A63B 67/08*** | (2006.01) |
| ***A63B 71/06*** | (2006.01) |
| *A63H 33/26* | (2006.01) |
| *A63H 5/00* | (2006.01) |

(52) U.S. Cl.

CPC ..... *A63H 33/00* (2013.01); *A63B 67/086* (2013.01); *A63B 71/0622* (2013.01); *A63B 2071/0625* (2013.01); *A63B 2207/02* (2013.01); *A63B 2220/13* (2013.01); *A63B 2220/40* (2013.01); *A63B 2220/64* (2013.01); *A63B 2220/806* (2013.01); *A63B 2220/833* (2013.01); *A63B 2225/50* (2013.01); *A63H 5/00* (2013.01); *A63H 33/26* (2013.01)

(58) Field of Classification Search

CPC ..... A63B 2220/806; A63B 2220/833; A63B 2225/50

USPC ..... 446/486, 462

See application file for complete search history.

(56) References Cited

U.S. PATENT DOCUMENTS

| | | | | |
|---|---|---|---|---|
| 2,213,046 | A * | 8/1940 | Mather | 131/240.1 |
| 2,455,544 | A * | 12/1948 | Yonkers | 285/7 |
| 2,658,628 | A | 11/1953 | Hilgen | |
| 2,778,508 | A | 1/1957 | Berger | |
| 2,933,201 | A | 4/1960 | Anderson | |
| 3,222,096 | A * | 12/1965 | Kaman | 403/372 |
| 3,972,078 | A * | 8/1976 | Maki | 4/287 |
| 4,219,123 | A | 8/1980 | Saeki | |
| 5,120,261 | A | 6/1992 | Dietzman | |
| 5,302,148 | A | 4/1994 | Heinz | |
| 5,310,359 | A * | 5/1994 | Chadbourne et al. | 439/462 |
| 6,217,451 | B1 * | 4/2001 | Kooy et al. | 464/68.92 |
| 7,192,328 | B2 | 3/2007 | Zawitz | |
| 7,601,045 | B2 | 10/2009 | Zawitz | |
| 8,303,366 | B2 | 11/2012 | Tremblay et al. | |

* cited by examiner

*Primary Examiner* — Vishu Mendiratta

(57) ABSTRACT

A toy apparatus including a guide having one or more tracks; a helical spring coil having first and second ends and a plurality of turns (T) situated about and defining a center axis between first and second ends of the helical coil spring; and/or a coupler which couples the and second ends of the helical spring coil to each other so as to form center opening configured to receive the one or more tracks, wherein an outer surface of one or more of the plurality of turns is in contact with the one or more tracks so that the helical coil spring rotates in a substantially poloidal direction about the central axis when traveling axially along the guide.

21 Claims, 25 Drawing Sheets

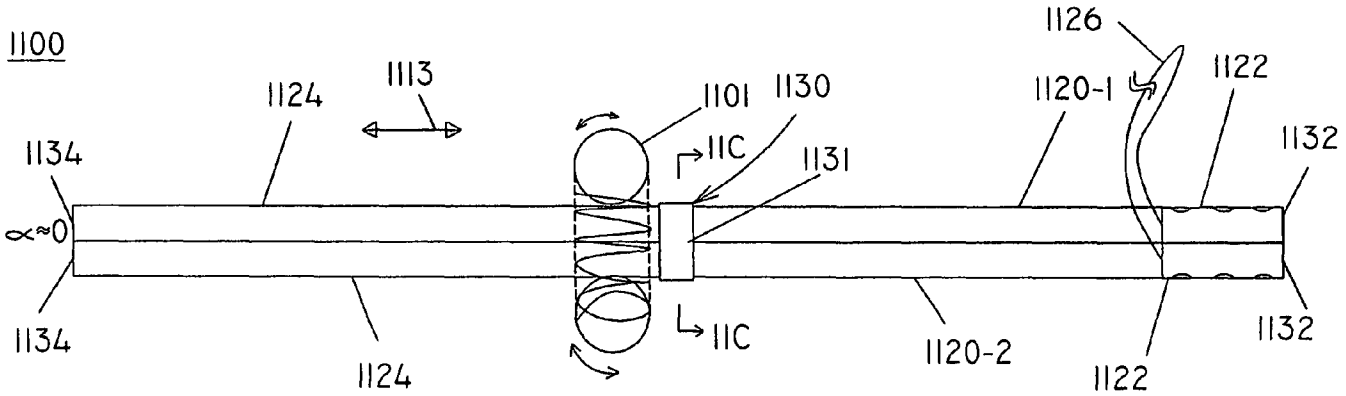
FIG. 11A
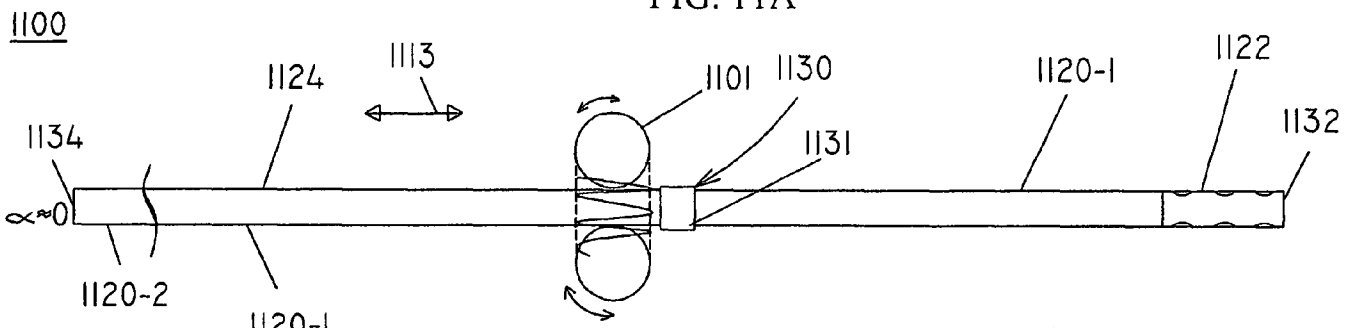
FIG. 11B
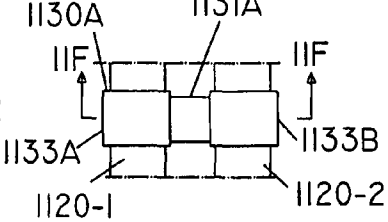
FIG. 11C
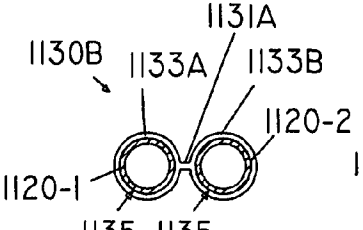
FIG. 11F
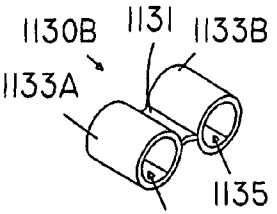
FIG. 11D
FIG. 11E

1100

HELICAL SPRING TOY AND METHOD OF USE THEREOF

REFERENCE TO PRIORITY APPLICATION

This application claims priority to U.S. Provisional Application Ser. No. 61/598,538, filed Feb. 14, 2012, entitled "HELICAL SPRING TOY AND METHOD OF USE THEREOF." the contents of which are incorporated herein by reference in its entirety.

FIELD OF THE PRESENT SYSTEM

The present system relates to a toy, and more particularly, to a coiled toy apparatus and a method of use and manufacture thereof.

BACKGROUND OF THE PRESENT SYSTEM

Toy helixes, springs, and/or coils (hereinafter each of will be commonly referred to as a helical spring for the sake of clarity unless the context indicates otherwise) such as the SLINKY™ are well known and described in U.S. Pat. Nos. 2,415,012, 4,114,306, 5,626,505, 7,731,562, 7,156,716, D352,971, and D480,769 and U.S. Pat. Publication No. 2002/0102912, the contents of each of which is incorporated herein by reference in their entirety. The coils may be formed from a resilient material such as metal (e.g., spring steel, etc.), plastic, carbon fiber, fiberglass, rubber, wood, paper, etc., and/or combinations thereof.

SUMMARY OF THE PRESENT SYSTEM

In accordance with an aspect of the present system, there is disclosed a system, apparatus, method, device, computer program, user interface, and/or apparatus (hereinafter each of which will be commonly referred to as a system unless the context indicates otherwise for the sake of clarity), which discloses a toy apparatus including a guide having one or more tracks; a helical spring coil having first and second ends and a plurality of turns (T) situated about and defining a center axis between first and second ends of the helical coil spring; and % or a coupler which couples the and second ends of the helical spring coil to each other so as to form center opening configured to receive the one or more tracks, wherein an outer surface of one or more of the plurality of turns is in contact with the one or more tracks so that the helical coil spring rotates in a substantially poloidal direction about the central axis when traveling axially along the guide.

In accordance with embodiments of the present system there is disclosed a toy comprising: a guide having one or more tracks; a helical spring coil having first and second ends and a plurality of turns (T) situated about and defining a center axis between first and second ends of the helical coil spring; and/or a coupler which couples the and second ends of the helical spring coil to each other so as to form center opening configured to receive the one or more tracks, wherein an outer surface of one or more of the plurality of turns is in contact with the one or more tracks so that the helical coil spring rotates in a substantially poloidal direction about the central axis when traveling axially along the guide. The coupler may couple the first and second ends of the helical coil spring together so that the helical coil spring forms a torus-like shape in a relaxed closed state. It is further envisioned that the coupler may include one or more of an adhesive, a hook and loop fastener, a friction-type fastener, and a magnetic fastener. Further, each track of the one or more tracks has a variable cross-section or a constant cross section, the variable cross-section configured to stretch the helical spring coil as the helical spring coil changes location relative to a corresponding track of the one or more tracks.

It is also envisioned that the one or more tracks may are adjustable relative to each other configured to stretch the helical spring coil along the center axis so as to change the shape or size of the center opening from a shape and size of the center opening in a relaxed closed state. Moreover, the helical spring coil may be configured to travel axially along the guide in accordance with one or more of an inclination and tilt of the guide portions. Further, the guide may include a hinge coupled to one or more rails of the plurality of rails and configured to control location of the of the coupled one or more rails. Moreover, the guide may include one or more restrainers configured to limit the separation two or more rails of the plurality of rails from each other. Further, the distance between portions of the plurality of rails is adjustable so as to form an inclined plane. Moreover, the guide may include at least one handle suitable for grasping by a user or one or more bends situated along a length of the guide. Moreover, it is envisioned that the toy may include a controller which determines one or of a location, speed, and direction of the helical coil spring and determines a score in accordance with the determination.

In accordance with yet another embodiment of the present system, there is disclosed a toy including a helical spring coil having first and second ends and a plurality of turns turned about and defining a center axis between first and second ends of the helical coil spring, the helical spring coil bent substantially in a closed axial circle by a coupler so as to define a center opening for receiving a guide member, wherein the helical spring coil is configured to rotate in a modified poloidal direction ($\theta$) about the central axis when subject to an external force when traveling axially along the guide member. The guide member may include one or more of a stick, a rod, a pole, a cone, a baton, a cylinder, a bottle, a pipe, a track, a tube, a hose, a rope, and a rail. Further, the guide may include one or more of a turn, a twist, and a knot along a length thereof.

Moreover the helical spring coil further may include one or more light sources coupled to one or more of the plurality of turns. Further, the toy may include a controller electronically coupled to the one or more light sources and which controls the operation of the one or more light sources to form desired text or graphics. Moreover, it is envisioned that the controller may control operation of the one or more light sources in accordance with one or more of time, acceleration in one or more axes, a value of ($\theta$), a change of ($\theta$) over time, a position of the helical spring coil relative to a toroidal axis ($\phi$), a change in ($\phi$) over time, and a location of the a helical spring coil relative to the guide. Moreover, the toy may include a speaker electronically coupled to the controller and which outputs an audible signal output by the controller. It is also envisioned that the controller may determine a position of the helical spring toy relative to the guide member and outputs an audio signal based upon the determined position. Further, the toy may include a second helical spring coil having first and second ends and a plurality of turns turned about and defining a center axis between first and second ends of the second helical coil spring, the second helical spring coil bent substantially in a closed axial circle by a coupler so as to define a center opening for receiving a guide member, wherein the second helical spring coil is configured to rotate in a poloidal direction (θ) about the central axis when subject to an external force when traveling axially along the guide member.

BRIEF DESCRIPTION OF THE DRAWINGS

The invention is explained in further detail, and by way of example, with reference to the accompanying drawings wherein:

FIG. 11A is a side view of a portion of an apparatus in accordance with embodiments of the present system;

FIG. 11B is a top view of a portion of the apparatus of FIG. 11A in accordance with embodiments of the present system;

FIG. 11C is a cross sectional view of the apparatus taken along lines 11C-11C of FIG. 11B;

FIG. 111D is a perspective view of an elastic coupler in accordance with embodiments of the present system;

FIG. 11E is a top view of the elastic coupler of FIG. 11D in accordance with embodiments of the present system;

FIG. 11F is a cross sectional view of the elastic coupler taken along lines 11F-11F of FIG. 11E in accordance with embodiments of the present system;

DETAILED DESCRIPTION OF THE PRESENT SYSTEM

The following are descriptions of illustrative embodiments that when taken in conjunction with the following drawings will demonstrate the above noted features and advantages, as well as further ones. In the following description, for purposes of explanation rather than limitation, illustrative details are set forth such as architecture, interfaces, techniques, element attributes, etc. However, it will be apparent to those of ordinary skill in the art that other embodiments that depart from these details would still be understood to be within the scope of the appended claims. Moreover, for the purpose of clarity, detailed descriptions of well-known devices, circuits, tools, techniques and methods are omitted so as not to obscure the description of the present system. It should be expressly understood that the drawings are included for illustrative purposes and do not represent the scope of the present system. In the accompanying drawings, like reference numbers in different drawings may designate similar elements.

For purposes of simplifying a description of the present system, the terms "operatively coupled", "coupled" and formatives thereof as utilized herein refer to a connection such as an electrical connection and/or a mechanical connection between devices and/or portions thereof that enables operation in accordance with the present system.

Figure 1:
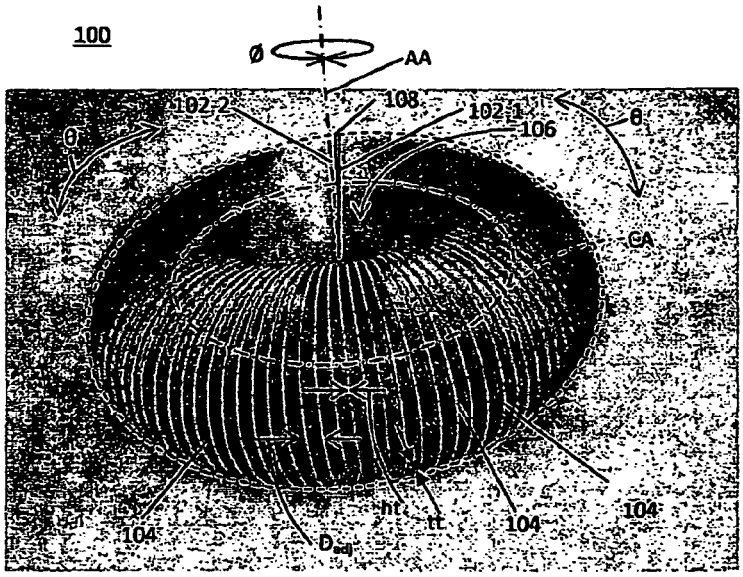
FIG. 1 is a perspective view of a helical coil spring (HCS) in a natural state in accordance with embodiments of the present system.

FIG. 1 is a perspective view of a helical coil spring (HCS) 101 in a natural state in accordance with embodiments of the present system. The helical spring 101 may include first and second ends 102-1 and 102-2 (generally **102-*x*) and may include a plurality of turns 104 situated about and defining a center axis (CA) substantially between the ends 102-*x*. A coupler 108 may couple ends 102-1 and 102-2 of the helical spring 101 together using any suitable method (e.g., using pressure-sensitive adhesives, hook-and-loop fasteners, etc., as may be described elsewhere) so that the HCS 101 forms a closed loop having a central opening 106 and defining an axial axis (AA). Accordingly, the CA may form a closed or substantially closed loop. In FIGS. 2 through 36 the HCSs may be similar to the HCS 101**.

The HCS 101 may be formed from one or more helical springs each of which may, for example, be comprised of a SLINKY™-type helical spring such as may be described in the aforesaid U.S. Pat. Nos. 2,415,019, 7,731,562, etc. In a natural state, when substantially no external forces are acting upon the HCS 101, it may form a torus-like shape having a toroidal axis (TA) which may correspond with the central axis (CA). Further, the turns 104 of the HCS 101 may rotate about the CA in a direction (e.g., a substantially poloidal direction) as indicated by theta (θ) as shown in FIG. 1. However, when subject to external forces (e.g., from acceleration, vibration, deflection, tension, compression, etc.), the HCS 101 may be deformed and may assume other shapes. As the CA may change shapes in accordance with the stretching of the HCS 101, it may differ from the TA. However, regardless of changes in the shape of the HCS 101 (e.g., oval, torus, circular, etc.) as may occur during use of embodiments of the present system, the rotation of the turns 104 of the HCS 101 may be referred to as a rotation in the poloidal direction and may be illustrated as theta (θ). Further, if the HCS 101 is formed using a plurality of helical coil springs, each helical coil spring may be attached to each other using couplers which, for example, may be similar to the coupler 108. The free ends of the plurality of coupled helical coil springs may be attached to each other so as to form the HCS 101. Moreover, when subject to a force from a user the coupler 108 may release the ends **104-*x* of the HCS 101 from each other. Further, it is envisioned that one or more turns 104 of the HCS 101 may overlap each other and the coupler may couple two of the overlapped turns 104 to each other. In yet other embodiments, it is envisioned that the HCS 101** may be formed from other types of springs such as wave spring.

Figure 2:
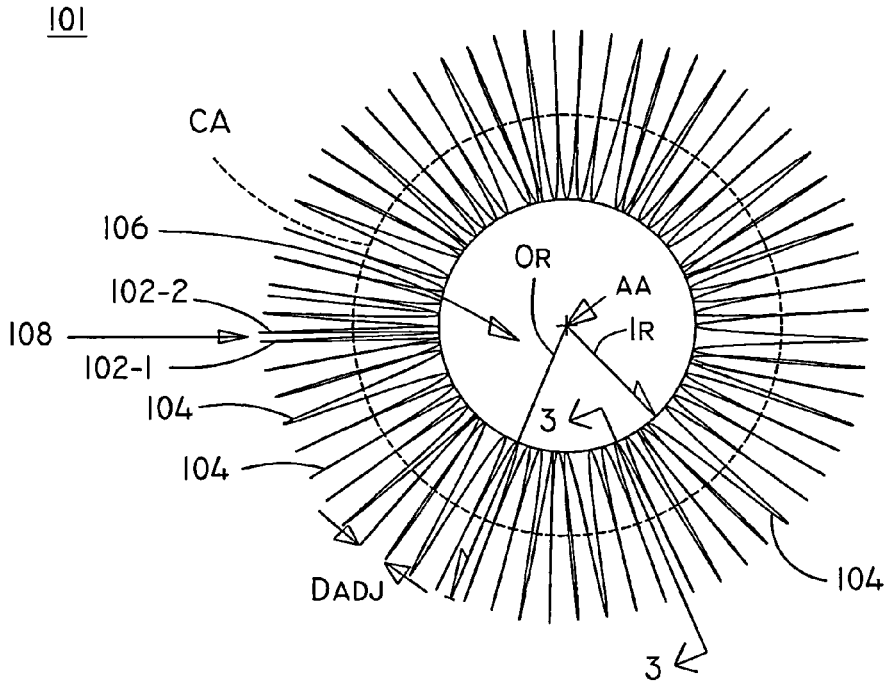
FIG. 2 is a top planar view of the HCS of FIG. 1 shown in a natural state in accordance with embodiments of the present system.

FIG. 2 is a top planar view of the HCS 101 of FIG. 1 shown in a natural state in accordance with embodiments of the present system. The central opening 106 may have a shape and/or size suitable for receiving one or more objects such as links as will be described elsewhere. Further, the central opening 106 may stretch to conform to other object inserted therethrough. Accordingly, the HCS 101 may be placed about an object such as the link (e.g., a rod, a cylinder, a stick, a cone, a baton, a sinusoidal shape, a curved rod, etc.) and one or more external surfaces of the HCS 101 may exert a biasing force about one or more portions of the link. Then, when moved relative to an axial axis of the HCS 101 and along the object inserted through the central opening 106, the turns 104 of the HCS 101 may rotate about the CA of the HCS 101 as illustrated by theta (θ) of FIG. 1 which may be known as a poloidal direction (PD). This rotation may be due to a frictional force between an external surface of one or more turns 104 of the HCS 101 and a surface of the object in the PD. As discussed above, although the HCS 101 may assume a torus-like shape under certain conditions (e.g., without significant external forces), it may be deformed and assume other shapes. Accordingly, when the HCS 101 is deformed (e.g., and does not assume a torus-like shape), the PD may correspond with an angular rotation of each turn about the CA. It is further envisioned that the shape and/or size of the central opening 106 vary based upon objects inserted therethrough and/or external forces acting upon the HCS 101. Distances between adjacent surfaces of adjacent turns 104 may be denoted by ($d_{adj}$) and may vary based upon angular position (e.g., location) about the CA. Accordingly, when in a natural state, adjacent surfaces of adjacent turns may be in contact with each other at the inner diameter (id) and may be separate from each other at an outer diameter (od) of the HCS 101. However, when the HCS 101 is stretched due to external forces (e.g., static and/or dynamic), adjacent turns 104 may move apart from each other and may no longer touch each other at the id.

Figure 3:
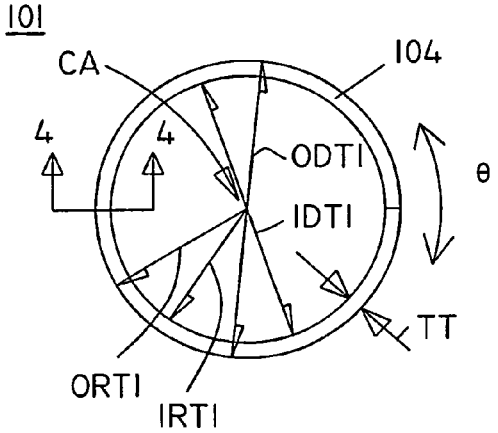
FIG. 3 is a cross sectional view of the HCS taken along lines 3-3 of FIG. 2 in accordance with embodiments of the present system.

FIG. 3 is a cross sectional view of the HCS 101 taken along lines 3-3 of FIG. 2 in accordance with embodiments of the present system. Each turn 104 of the HCS 101 may have an outer diameter (odt) and an inner diameter (idt) when measured from the CA of the corresponding turn. Accordingly, each turn 104 may have a thickness (tt) which may be constant or may vary with position and may be defined as a difference between the odt and the idt. Further, the thickness (tt) of adjacent turns 104 of the HCS 101 may be constant or may vary relative to each other.

Figure 4:
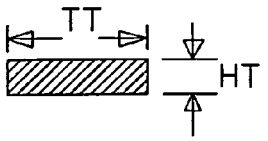
FIG. 4 is a cross-sectional view of the HCS taken along lines 4-4 of FIG. 3 in accordance with embodiments of the present system.

FIG. 4 is a cross-sectional view of the HCS 101 taken along lines 4-4 of FIG. 3 in accordance with embodiments of the present system. Each turn 104 may have a height (ht) which may be constant or may vary based upon position relative to the CA. Further, the height (ht) of adjacent turns 104 may vary from each other. Further, the thickness tt and/or height ht of each turn 104 may be varied to change a spring constant of the corresponding turn 104 of the HCS 101. Although a square cross section for turns 104 is shown for the sake of clarity, in alternative embodiments, it is envisioned that the turns 104 may have cross-sections with other shapes and/or sizes. Accordingly, it is envisioned that upper and/or lower surfaces (us) and (ls), respectively, of the turn 104 may include a rounded area, a bend, a crescent, etc.

Figure 5B:
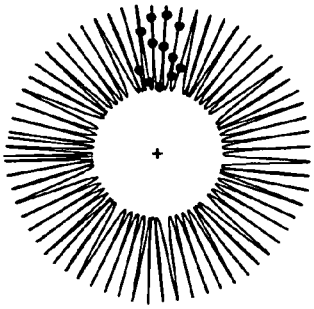
FIG. 5B is a front view of an HSC outputting a light pattern including an "S" in accordance with an embodiment of the present system.
Figure 5:
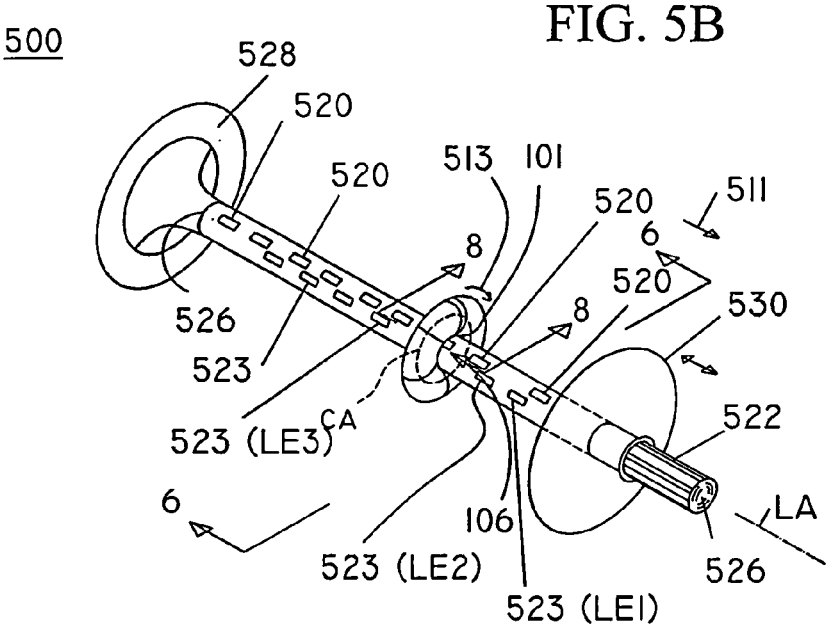
FIG. 5 is a perspective view of an apparatus in accordance with embodiments of the present system.

FIG. 5 is a perspective view of an apparatus 500 in accordance with embodiments of the present system. The apparatus 500 may include a link 520 and the HCS 101. The link 520 may have a body 524 defining a path and situated between opposed ends 526. The HCS 101 may be placed about the link 520 such that the link 520 is located within the central opening 106 of the HCS 101. When subject to a motive force (e.g., gravity, a centripetal force, etc.) sufficient to cause the HCS 101 to move along its axial axis (AA) in the direction of arrow 511 along a longitudinal axis (LA) of the link 520, the HCS 101, the turns 104 of the HCS 101 may rotate about the CA of the HCS 101 axis as illustrated by arrow 513 as it moves in the direction of the arrow 511 relative to the link 520. Further, when moving in a direction opposite to arrow 511, direction 513 may be reversed.

The link 520 may include more handles 522 suitable for grasping by a user and may include one or more bumpers 528 to limit travel of the HCS 101 such as at the ends 526. One or more of the bumpers 528 and/or 530 may include a tapered area to stretch the HCS 101 so as to slow the HCS 101 and/or rebound the HCS 101. Accordingly, one or more of the bumpers 528 and/or 530 may convert momentum or kinetic energy of the HCS 101 as it hits and/or rides upon the corresponding bumper 528, 530 to potential energy which may then be used by the spring to rebound off of the corresponding bumper 528, 530. The shape of the bumpers 528, 530 may be the same as, or different from, each other and may include, for example, various shapes and/or patterns such as a ball, a cone, a disc, etc., which may limit travel of the HCS 101 when the HCS 101 contacts the corresponding bumper 528, 530. For example, the bumper 528 may include a conical-like shape while the bumper 530 may include a disc-like shape. However, it is also envisioned that the bumpers 528, 530 may include other patterns, shapes, etc., if desired such as a flower-like shape, a character or movie-theme shape (e.g., Batman™, Mickey Mouse™, etc.), etc. The bumpers 528 and/or 530 may be attached to, or formed integrally with, the body 524 of the link 520, and may be attached to the body 524 using any suitable method such as by using friction, latches, adhesives, pins, screws, rivets, bonds, welds, etc. It is further envisioned that a position of one or more of the bumpers 528, 530 may be adjusted relative to the body 524 (and thereafter locked in place). Further, one or more of the bumpers 528, 530 may be removed from the body 524, if desired. The body 524 of the link 520 may be cylindrical (as shown) or may include a taper so as to be conical in shape. However, other shapes and/or sizes are also envisioned. Further, it is envisioned that the body 524 of the link 520 may form a helix such as a single or multi-helix (e.g., a double or triple helix) with one or more turns along its length. The one or more handles 522 may be suitable for grasping by a user and may have a location that is variable. For example, by placing the handle 522 at a center of the body 524 and the bumpers 528 and 530 at opposite ones of the ends 526 of the body 524, two HCSs 101 may be placed around the body 524 one each at opposite side of the handle 522 or center of the body 524.

Sensors 520 may sense a position of the HCS 501 relative to the body 524 and may provide corresponding sensor position information to a controller. The controller may then determine frequencies (e.g., notes) to output on a speaker (e.g., remote or local) of the apparatus 500. Accordingly, for example, as the HCS 501 moves to relative to the body 524 different sounds (e.g., musical notes, etc.) may be output by the speaker. Thus, a user may manipulate the apparatus 500 so as to cause different notes to be played. Further, light emitters (e.g., LEDs) may be positioned on the body portion 524 and may be controlled by the controller to illuminate. The controller may control the light emitters to illuminate in accordance with certain rules. For example, in a first embodiment, the controller may determine notes to be played and controllably illuminate the LEDs which are adjacent to (or otherwise within a certain area) of sensors corresponding with the notes. Accordingly, a user may be taught how to play notes using the apparatus 500. Thus, each sensor 520 may be associated with a corresponding light emitter (LE). Further, in other embodiments, the controller may cause the LEs to illuminate in a certain pattern (e.g., LE 1→LE 5→LE 2, etc.) and thereafter await information from the sensors 520 which may be indicative of the same or similar patters (e.g. upon detecting movement of the HCS 501). Thus, the controller may output a movement pattern (right, left, stop, left, right or LE 1, LE 3, LE3, LE5, LE1, etc.) and await a user to move the HSC 501 in the same pattern which may then be sensed by the sensor 520 (e.g., a sensed movement pattern) and provided to the controller. The controller may then determine whether the sensed movement pattern corresponds with the output light pattern, if it is determined that the sensed movement pattern corresponds with the output light pattern, the controller may determine points (e.g., +5), and/or inform a user (e.g. using a light pattern and/or sound pattern indicative (e.g., from a memory of the system) of a successful emulation of the output pattern). However, if it is determined that the sensed movement pattern does not correspond with the output light pattern, the controller may determine points (e.g., −5) or outs (e.g., 1 out), and/or inform a user (e.g. using a light pattern and/or sound pattern indicative (e.g., from a memory of the system) of an unsuccessful emulation of the output pattern). Accordingly, the present system may provide an apparatus and system enhance hand/eye coordination of a user as the user attempts to manipulate the apparatus to emulate the patterns. Further, the notes and/or sounds output may correspond with advertising notes (e.g., the NBC™, jingle, a scale, etc.).

Further, the turns of the HSC may include light emitters (LEs such as light emitting diodes (LEDs), etc.) which may be controlled by the processor in accordance with a rotation of the HSC about its CA. Thus, textual and/or graphical light patterns such as "SLNKY™", etc., (synchronously and/or one letter at a time depending upon configuration) may be output by the HSC as it rolls over its CA. This may be useful for advertising and/or promotions. However, further, it is envisioned that a user may select graphics and/or text to be output. The controller may then determine position of the HSC and control the LEs to output illumination accordingly. Accordingly, the apparatus may include a sensor to determine an angle of rotation of the HSC about its CA.

Figure 6:
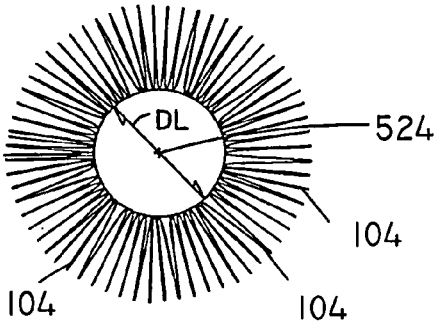
FIG. 6 is a cross-sectional view of a portion of the link taken along lines-6-6 of FIG. 5 in accordance with embodiments of the present system.

FIG. 6 is a cross-sectional view 600 of a portion of the link 520 taken along lines-6-6 of FIG. 5 in accordance with embodiments of the present system. For the sake of clarity, fewer than an actual number of turns 104 of the HCS 101 are shown. When not subject to significant external forces, exterior portions of one or more of turns 104 adjacent to the body 524 may contact an exterior surface of the body 524 of the link 520. However, when subject to exterior forces which may stretch the HCS 101 (e.g., such as may occur during use, etc.), the HCS 101 may contort and no longer assume a torus-like shape. Accordingly, exterior portions of one or more of the turns 104 may separate from (e.g., no longer contact) adjacent exterior surfaces of the body 524.

Figure 7:
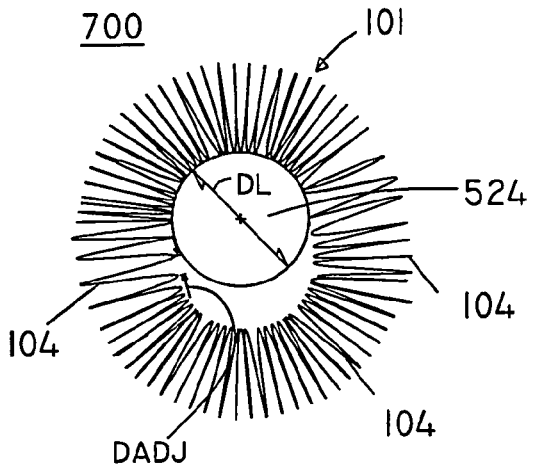
FIG. 7 is a cross-sectional view of a portion of the link taken along lines-6-6 of FIG. 5 in accordance with embodiments of the present system.

FIG. 7 is a cross-sectional view 700 of a portion of the link 520 taken along lines-6-6 of FIG. 5 in accordance with embodiments of the present system. The cross sectional view 700 is similar to the cross section 600. However, the HCS 101 is shown in a stretched state such as may occur during use, due to gravity, acceleration, etc. However, in a natural state (e.g., in a static state), it is preferred that a substantial number of the turns 104 of the HCS 101 are biased against an exterior of the body 524 of the link 520. Accordingly, the HCS 101 may be configured to bias itself against a selected link 520. Further, with regard to the distances between adjacent surfaces of adjacent turns 104 ($d_{adj}$) of the HCS 101 at the opening 106 when the HCS 106 is stretched (within a threshold usage stretch value) during use, it is envisioned that this distance remain much smaller than a diameter (or thickness) (dl) of the link 520 such that the link 520 does not ride up between adjacent turns 104 of the HCS 101 during use.

Figure 8:
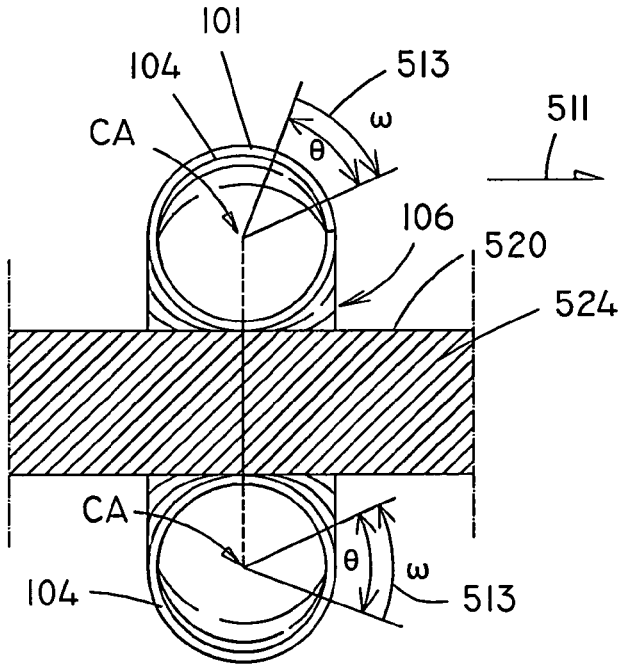
FIG. 8 is a cross-sectional view of a portion of the link taken along lines 8-8 of FIG. 5 in accordance with embodiments of the present system.

FIG. 8 is a cross-sectional view of a portion of the link 520 taken along lines 8-8 of FIG. 5 in accordance with embodiments of the present system. The link 520 is situated within the opening 106 of the HCS 101 such that one or more of the turns 104 of the HCS 101 are in contact with an exterior surface of the link 520. Accordingly, when subject to a force sufficient to cause the HCS to move in, for example, the direction 511, a frictional force between one or more turns 104 of the HCs 101 and an exterior surface of the link 520 may cause turns 104 in contact with the exterior surface of the HCs 101 to rotate about the CA at the location of the corresponding turn 104 of the HCS 101 as illustrated by displacement theta arrows 513. This, in turn, causes the HCS 101 to rotate about the CA (as illustrated by rotation theta (θ)) and move in the direction 511 (assuming there is little or no slippage between turns 104 in contact with the exterior surface of the link 520). Accordingly, the HCS 101 roll about its CA with an angular velocity ω and may have a corresponding rotational moment To enhance friction, between exterior surfaces of the HCS 101 and/or the link 520, one or more of these surfaces may include a friction enhancing material (e.g., neoprene, rubber, etc.).

Figure 9:
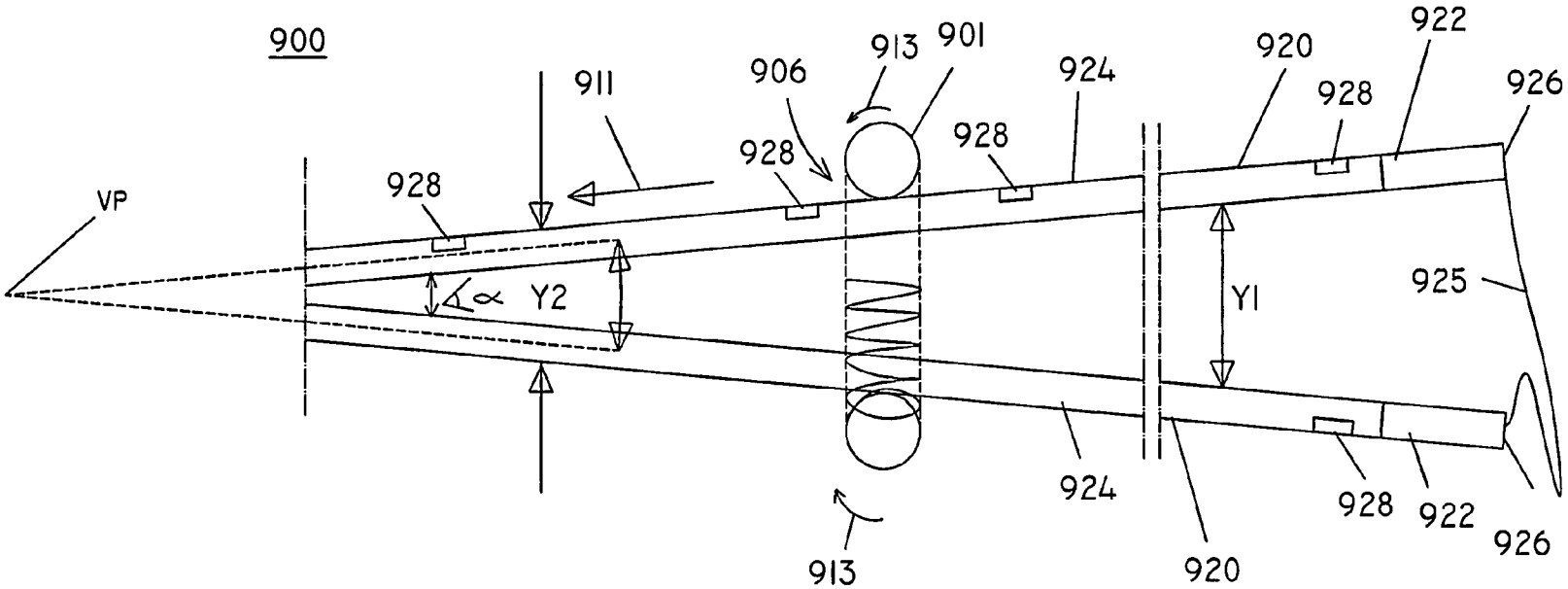
FIG. 9 is a side planar view of a portion of an apparatus including an HCS and links in accordance with embodiments of the present system.

FIG. 9 is a side planar view of a portion of an apparatus 900 including an HCS 901 and links 920 in accordance with embodiments of the present system. The HCS 901 may be similar to the HCS 101 and may include helical coil spring which is bent around is central axis so as to form a closed loop (e.g. a torus-like when not subject to exterior forces). The HCS 901 may include a plurality of turns 904 and a central opening 906 which may be similar to the central opening 106.

The links 920 may be similar to each other and may include a body portion 924 which may, for example, have a cylindrical shape (e.g. solid or hollow) with a solid or hollow cross-section. However, other shapes (e.g., elliptical, square, polygonal, etc.) and/or sizes are also envisioned. Further, the shape and/or size of a cross-section of the body portion 924 should be shaped and/or sized such that it does not unintentionally become caught between turns 904 of the HCS 901 during use. Accordingly, one or more of the links 920 may have a circular cross section having a diameter (or thickness when non round cross-sections are used) which is substantially larger than a distance between adjacent turns 904 of the HCS 901 when the HCS 901 is stretched or relaxed. This may prevent a corresponding link 920 from becoming unintentionally stuck between adjacent turns 904 of the HCS 901 during use. For the sake of clarity, diameters of the links 920 are shown smaller than they actually are relative to the size of the HCS 901.

The links 920 may include corresponding handles 922 suitable for grasping by a user and located at one or more locations of the with respect to the body portion 924 such as at one or more ends of the body portion 924. For example, for single-user applications, each of the links 920 may include a single one of the handles 922 which may be mounted at one end of a corresponding link 920 such as at ends 926. However, for dual-user applications, each of the links 920 may include a handle 922 at each end of the link 920. Further, it is envisioned that the handle(s) 922 may be separate from, of formed integrally with, the body portion 924 of a corresponding link 920.

With regard to cross-sections, it is envisioned that the body portion 924 may have a cross-section which has a shape and/or a size which may be constant (e.g., cylinder, etc.) or may change (e.g., a cone, ellipse, etc.) along a longitudinal length thereof. Further, it is envisioned that the body portion 924 may include other shapes or combinations of shapes such as a sinusoidal shape (e.g., having a circular or other shaped cross section) between ends thereof. Further, the ends of the link 970 situated about the body portion 924 may include a conical shaped area which may stretch the HCS 901 along its CA so as to slow the HCS 901 and/or cause the HCS 901 to slow or rebound in the opposite direction to its travel when the HCS 901 extends about the conical shaped area. As mentioned elsewhere, stretching the HCS 901 about its CA increases the potential energy of the HCS 901.

The body portion 924 may be formed using any suitable material such as wood, metal (e.g., aluminum, steel, etc.), plastic (e.g., PVC tubing), etc. and may be solid or hollow. The body portion 924 may further include a twist along its longitudinal length. This twist may act to cause the HCS 901 to rotate about its axial axis (AA) (e.g., in a toroidal direction) as it moves along its AA and/or a longitudinal axis of the body portion 924. Further, the body portion may be formed from a biasing member which may be easily deformed by a user and may spring back to a previous position during use. Moreover, although portions of substantially straight body portions 924 are shown, it is envisioned that portions of each of other body portions 924 may be bent in various shapes. For example, it is envisioned that the one or more body portions may be formed from a resilient material which may be bent into a desired shape (e.g., by a user) such as a metal (e.g., copper tubing, etc.) for use. Further, it is envisioned that the one or more body portions may include sections having one or more desired shapes such as a curve, a "J," a "U," a "W", a sinusoidal, etc. in one or more planes.

Usage of the apparatus 900 will now be described. In the present example, for the sake of clarity, it will be assumed that gravitational forces acting upon the HCS 901 are minimal unless the context indicates otherwise. The links 920 may be positioned (e.g., by a controller one or more users) relative to each other in one or more planes such as the x, y plane as will be assumed in the present example. The adjacent ends of the links 920 may be generally aligned with each other, if desired. Accordingly, it will be assumed that the links 920 are separated from each other so as to stretch the HCS 901. When the links are separated from each other so as to stretch the HCS 901 and are situated parallel (e.g., in the x, y plane) relative to each other, the HCS 901 may be subject to little or no motive force exerted upon the HCS 901. Accordingly, assuming that the HCS 901 in a static state (e.g., not moving), it will tend to remain in the static state. However, when the links 920 are separated from each other so as to stretch the HCS 901 and form an incline, a motive force will act upon the HCS 901 so as to reduce the stretch of the HCS 901. Accordingly, the motive force may act to move the HCS 901 in the direction in which the distance between the links 920 decreases (e.g., in a direction in which the incline decreases).

By orienting the links 920 in various directions (e.g., generally vertically, horizontally, e.g., in one or more axes, etc.), various forces such as the gravitational and acceleration forces acting upon the HCS 901 may be controlled so that the HCS 901 may travel upward against the gravitation force similarly to travel of a common yo-yo-type toy.

To prevent the permanent deformation of the HCS 901 caused by stretching the HCS 901 beyond its elastic limit (e.g., yield point), the separation of the links 920 may be limited using one or more restrainers coupled to the links 920. However, it is also envisioned that couplers may include restrainers to limit rotation of the links 920 relative to each other.

Further, the apparatus 900 may include one or more sensors such as proximity sensors 928 which may provide sensor information to a controller of the system for further processing. The sensors may be located on one or more of the links 920 and may include sensors such as a proximity sensor (e.g., to provide proximity information), an acceleration sensor (e.g., in one or more axes, etc.) to provide acceleration information, a gravity sensor (e.g., to provide orientation information), a rotation sensor (to provide angular information), an image sensor, a biometric sensor (e.g., a fingerprint sensor) to provide biometric information, etc. The proximity sensors may include sensors which may sense proximity and/or determine velocity of the HCS 901 and/or form corresponding sensor information. The proximity sensors may include, for example, include any suitable proximity sensor such as an optical sensor, an infra-red (IR) sensor, etc. The acceleration sensor may sense acceleration of one or more of the links 920 and/or the HCS 901 in one or more axes (e.g., x, y, and/or z) and may form corresponding sensor information. The gravity sensor may detect a gravitational force in one or more axes and may form corresponding gravity information. The rotation sensor may detect an angular rotation of links relative to each other and form corresponding angular rotation information. The image sensor may capture image information such as an image of a user and/or a portion of the apparatus 900 including the HCS 901 during use and form corresponding image information for rendering on a display of the system. Accordingly, the image sensor may include an image capture device such as a camera, a video camera, etc. The biometric sensor may include a biometric sensor which may capture biometric features of a user such as a user's face, fingerprint, retina, etc., and form corresponding biometric information. The biometric information may be used to identify a user and/or access an account (e.g., a game account, etc.) or account information (e.g., history information, user settings, etc.) of the identified user. The controller may use the orientation information to determine whether to turn on a display of the system (e.g., upon detecting that a user has picked up the apparatus), to determine a mode of operation (e.g., vertical operation mode, horizontal operation mode, etc.), and/or to determine whether the apparatus has been tilted during play beyond a threshold tilt level and if so may perform a corresponding action such as reduce a players score, add an out, etc.

After sensor information is formed by a corresponding sensor, it may be provided to the controller (e.g., via wired and/or wireless transmission methods) for further processing. The controller may form corresponding output information based upon the received sensor information and output this information on a display and/or store the output information in a memory of the system (e.g., in relation to the user) for further use. For example, when it is determined (by the controller) that the apparatus 900 has been moved (e.g., as a result of processing, for example, one or more of acceleration information, gravitational information, rotation information, image information, etc.), controller may perform a startup/reset procedure and may turn on circuits such as a user interface, etc. The controller may further, identify a user in accordance with a user identification entered via a user input device (e.g., a keyboard, a touch screen, etc.) or via processing the biometric information. For example, the controller may process the image information to identify a user (e.g., using a facial recognition technique or the like). The controller may further process the proximity information to determine a number of repetitions, acceleration, speed, and/or distance travelled by the HCS 901 relative to one or more of the links 920. The controller may then render the findings on a display of the system such as on a touch screen of the apparatus and may update user history information related to operation of the apparatus 900 by the user.

Figure 10:
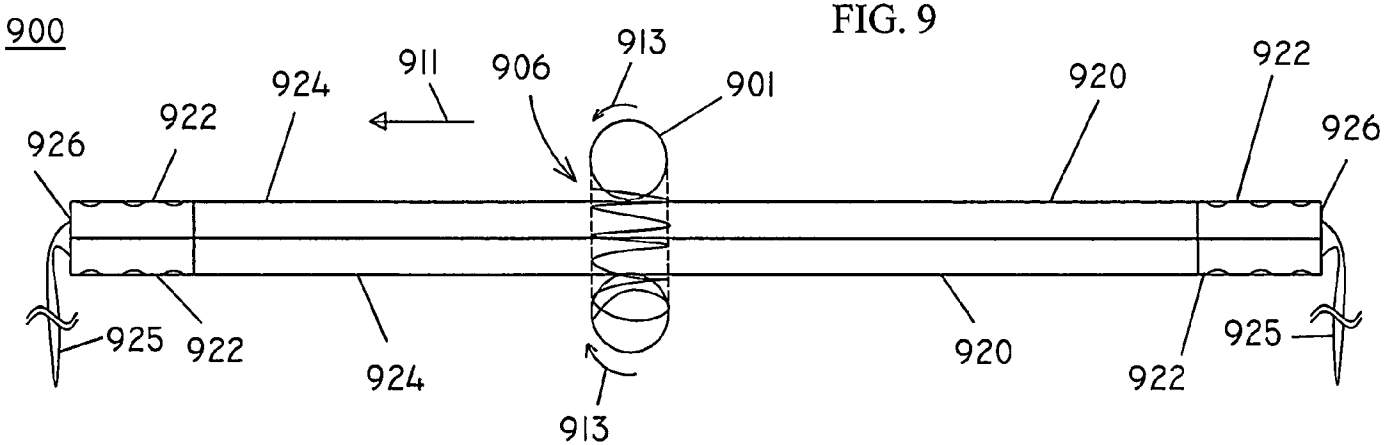
FIG. 10 shows a portion of the apparatus of FIG. 9 with the links in a substantially parallel orientation in accordance with embodiments of the present system.

FIG. 10 shows a portion of the apparatus 900 of FIG. 9 with the links 920 in a substantially parallel orientation in accordance with embodiments of the present system. The links 920 are shown in a substantially parallel orientation relative to each other and adjacent to each other so that the HCS 901 is in a substantially low potential energy state (e.g., a resting state). When the links 920 are in a substantially parallel orientation, there substantially no incline between the links 920 and, thus, motive forces due to any incline between the links 920 (hereinafter MF_Links) may be very small or non-existent. Accordingly, absent the MF_Links) HCS 901 may travel along the links 920 with little resistance which may be useful to maintain momentum of the HCS 901 for longer travel distances.

Referring to FIGS. 9 and 10, during use, a controller such as a user or a control apparatus may control the position of the links 920 relative to each other so as to control deflection of the HCS 901 and/or to control movement of the HCS 901. Further, the orientation of the links 920 and/or the HCS 901 may be controlled relative to horizontal, vertical axes of the Earth so as to control gravitational forces acting upon the HCS 901. For example, if the links 920 are generally pointed in a vertical direction, the force of gravity may pull downward on the HCS 901 so as to cause the HCS 901 to travel in a generally vertical direction towards the Earth. Then, the links 920 may be moved apart from each other at a certain location so as to counter the force of Gravity and cause the HCS 901 to reverse directions and travel in an upwards direction for a limited distance at which time the separation of the links 920 may be controlled once again to allow force of Gravity to cause the HCS 901 to reverse directions and travel downward once again. This process may be repeated. In a similar manner, the links 920 may be held in a generally horizontal direction and distance between portions of the links 920 may be controlled to provide a force to urge the HCS 901 to travel along the link 920 in a desired direction.

FIG. 11A is a side view of a portion of an apparatus 1100 in accordance with embodiments of the present system. The apparatus 1100 is shown in a closed position and may include one or more of an HCS 1101 and links 1120-1 and 1120-2 (generally 1120-*x*). The HCS 1101 may be similar to the HCS 101 and may include a plurality of turns 1104 situated about and defining a central axis (CA) of the HCS 1101. The links 1120-*x* may each include handles 1122 may be located at first ends 1132 of a corresponding link 1120-*x*. The handles 1122 may be formed integrally with, or separate from, bodies 1124 of corresponding links 1120-*x*. In some embodiments, it is envisioned that one or more of the links 1120-*x* may have a curve such an arc, etc., in one or more portions thereof.

The links 1120-*x* may be coupled to each other using any suitable coupler 1130 such as an elastic coupler such as an elastic band 1131 (e.g., a synthetic or natural rubber band, a plastic band, a latex band, etc.) having an opening through which the links 1120-*x* are located. Accordingly, the elastic band 1131 may bias the links 1120-*x* together. Further, the elastic band 1131 may provide a biasing force on the links 1120-*x* so that they are substantially parallel to each other (e.g., alpha=0) absent other forces. The coupled links 1120-*x* may rotate substantially about the coupler 1130 as shown in FIG. 12. The elastic band 1131 may act to limit rotation between the links 1120-*x* relative to each other. The elastic band 1131 should lie flat against the exterior surfaces of the links 1120-*x* such that the elastic band 1131 does not interfere with movement of the HCS 1101 during use.

It is envisioned that two or more couplers may be used to couple the links 1120-*x*. For example, a second elastic band may also be placed about the links 1120-*x* in a similar fashion as the elastic band 1131 and may be adjacent to or slightly separated from the elastic band 1121. The second coupler may provide a further biasing force to return the links 1120-*x* to a closed position (e.g., parallel position) relative to each other and, or to limit rotation of the links 1120-*x* about each other when in an open position.

The coupler 1130 may be positioned in one or more locations with respect to the links 1120-*x*. Accordingly, for example, a user may position the coupler 1130 in the symmetrically at center of the links 1120-*x* or asymmetrically closer to one end or another of the ends 1132 and 1134 of the links 1120-*x*. When the coupler 1130 is asymmetrically located relative to the links 1120-*x*, when the links 1120-*x* are opened at a first side (e.g., 1132), movement at the other end (e.g., 1134) of the links 1120-*x* may be amplified or attenuated depending upon position of the coupler 1130 relative to the links 1120-*x*.

An optional restrainer 1126 may be coupled to the links 1120 so as to limit separation of portions of the links 1120 to a range which would prevent stretching of the HCS 1101 beyond the elastic limit of the HCS's 1101 at which point the HCS 1101 may be damaged by the stretching. The restrainer 1126 may include a biasing member such as a strap, a string, a cord (e.g., a rubber, plastic, cloth, leather, latex, etc.), a band (e.g., a rubber band, etc.), a spring, a chain (e.g., a linked chain, etc.), etc. The restrainer 1126 may be attached to the handles 1122 or to the body 1124 of the links 1120.

FIG. 11B is a top view of a portion of the apparatus 1100 of FIG. 11A in accordance with embodiments of the present system. The apparatus 1100 is shown in the closed position. The links 1120-*x* may be similar to each other or may differ from each other in size, shape, etc. However, for the sake of clarity, it will be assumed that the links 1120 are similar to each other. The HCS 1101 may rotate about its CA and/or may move along its axial axis as illustrated by arrow 1113.

FIG. 11C is a cross sectional view of the apparatus 1100 taken along lines 11C-11C of FIG. 11B. The links 1120-*x* may be formed from any suitable material and may have a solid or hollow center as shown. The elastic band 1131 may couple the links 1120-*x* to each other. The links 1120-*x* may include notches and/or buttons to positively locate the elastic band 1131, if desired.

FIG. 11D is a perspective view of an elastic coupler 1130B in accordance with embodiments of the present system. The elastic coupler 1130B may be formed from any suitable elastic material (e.g., plastic, synthetic rubber, natural rubber, latex, etc.) and may include rings 1133A and 1133B (generally 1133-*x*) coupled to each other by a center portion 1131A. The rings 1133-*x* may include openings 1135 configured to receive links such as the links 1120-*x*. The center portion 1131A may have a desired length so as to separate the links 1120-*x* by a desired distance. Accordingly, the elastic coupler 1130B may couple links such as the links 1120-*x* together. Further, to couple more than two rings, a further number of rings may be coupled to each other by the center portion 1131A.

FIG. 11E is a top view of the elastic coupler 1130B of FIG. 11D in accordance with embodiments of the present system. Links such as the links 1120-*x* may pass through corresponding ones of the openings 1135 of the rings 1133-*x* and be held in position by a biasing force of the corresponding ones of the rings 1133-*x*.

FIG. 11F is a cross sectional view of the elastic coupler 1130B taken along lines 11F-11F of FIG. 11E in accordance with embodiments of the present system.

Figure 11G:
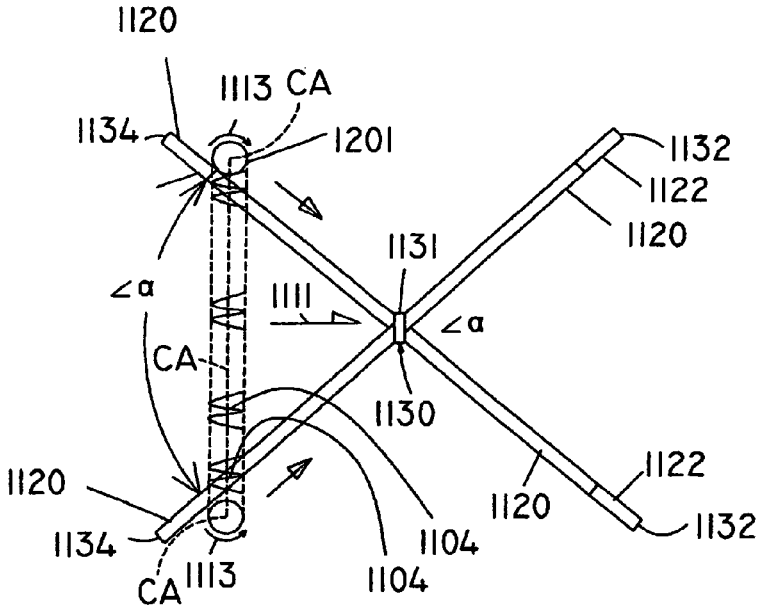
FIG. 11G is a top view of a portion of the apparatus 1100 of FIG. 11A in accordance with embodiments of the present system.
Figure 11H:
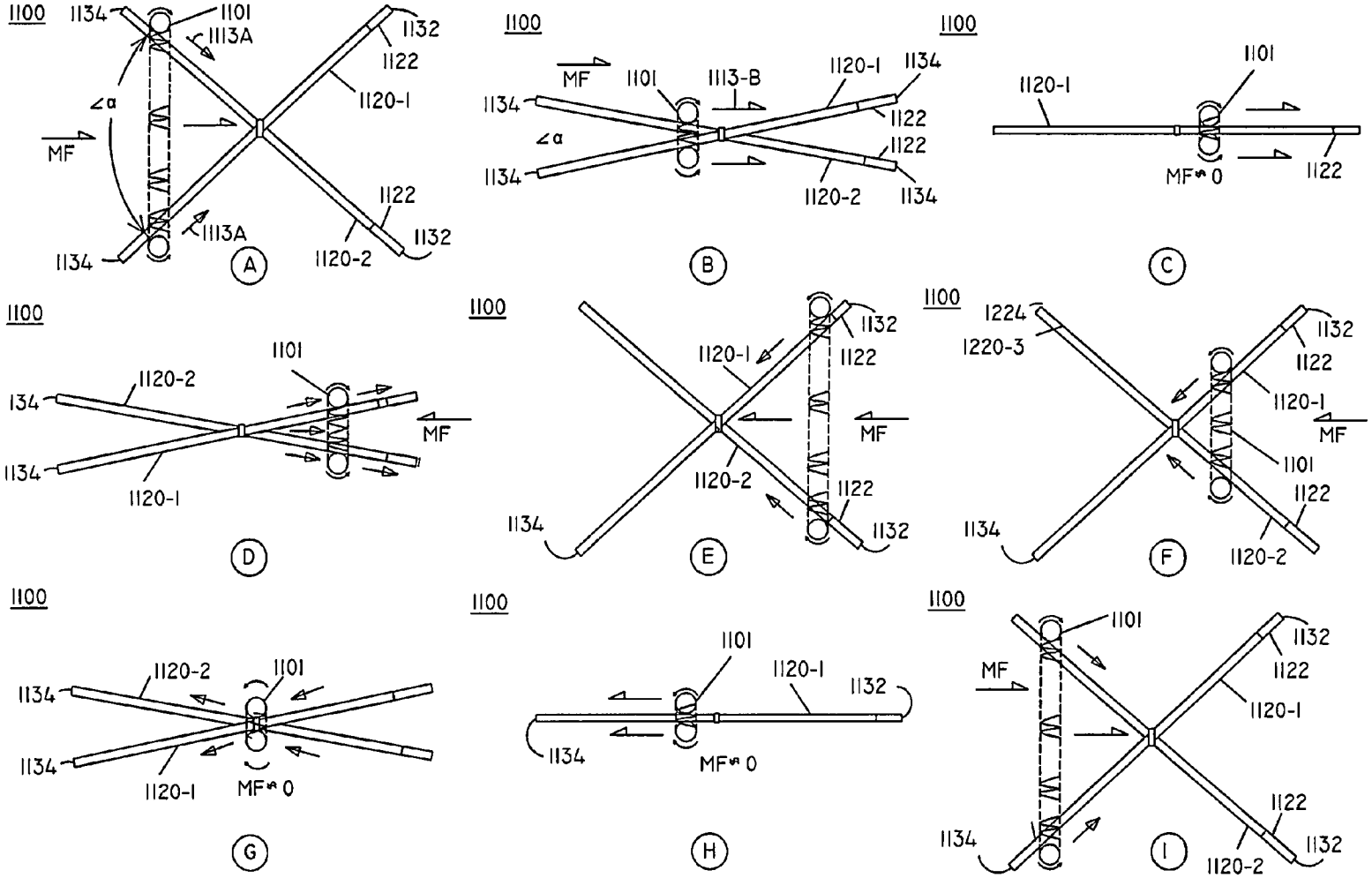
FIG. 11H shows a sequence of acts of a user or controller may perform to cause the HCS to move between ends of the links in accordance with embodiments of the present system.

FIG. 11G is a top view of a portion of the apparatus 1100 of FIG. 11A in accordance with embodiments of the present system. The apparatus 1100 is shown in an open position. In the open position the links 1120 may be angled relative to each other about a rotational axis (e.g., one or more actual or virtual) of the hinge 1130 so as to form an inclined plane with respect to the links 1120-*x* in one or more axes (however, for the sake of clarity, only the x, y, axis will be discussed). Further, when the links 1120-*x* are rotated to the open position, the HCS 1101 may be stretched (e.g., depending upon location relative to the links 1120-*x*, thus, increasing its elastic energy from its natural state) and may attempt to return to its natural state (e.g., to decrease potential energy of the HCS 1101) by moving down the inclined plane (e.g., towards the coupler 1130 as illustrated by arrow 1111). Accordingly, as the HCS 1101 moves along exterior surfaces of the links 1120-*x*, a frictional force between and outer surface of turns 1104 of the HCS 1101 in contact with the exterior surfaces of the links 1120-*x* may act to rotate the HCS 1101 about its CA as illustrated by arrow 1113. By varying opening and/or closing of the apparatus 1100, a user or controller in accordance with embodiments of the present system may cause the HCS to move between the ends 1132 and 1134 of the links 1120-*x*. This process is more clearly illustrated with reference to FIG. 11H which shows a sequence of acts of a user or controller may perform to cause the HCS 1101 to move between ends 1132 and 1134 of the links 1120-*x* in accordance with embodiments of the present system. During act A, the links 1120-*x* are in the fully opened position, the HCS 1101 may be stretched and a motive force (MF) may act to move the HCS in the direction of line 1113-A. During act B, the links 1120-*x* may be partially closed as the HCS 1101 acquires momentum and moves towards the coupler (or axis of rotation of the links 1120-*x*). During act C, as the HCS 1101 passes the coupler and continues towards ends 1132 of the links 1120-*x*, the links 1120-*x* are substantially closed so as to minimize any MF against the direction of movement of the HCS 1101. During act D, the links are opened to stretch the HCS 1101. Accordingly, an MF acts in a direction opposed to the direction of travel of the HCS 1101 so as to slow the HCS 1101 to a stop before it passes over the ends 1132 of the links 1120-*x*. During act E, the HCS 1101 is brought to a stop close to the ends 1132 of the links 1120 and is stretched. Accordingly, the MF acts to return the HCS 1101 towards the other ends 1134 of the links 1120-*x* and the HCS 1101 may begin to travel towards the ends 1134. During act F, similarly to act B, the links 1120-*x* may be partially closed as the HCS 1101 acquires momentum and moves towards the coupler (or axis of rotation of the links 1120-*x*). Accordingly, the MF is decreasing. During act G, the HCS passes over the coupler 1130 and is substantially unstretched. The links 1120-*x* closed or in the process of being closed. During act H, similarly to act C (but in an opposite direction), the HCS 1101 passes the coupler 1130 and continues towards ends 1134 of the links 1120-*x*, the links 1120-*x* are substantially closed so as to minimize any MF against the direction of movement of the HCS 1101. During act D, the links are opened to stretch the HCS 1101 and so as to provide a MF against the direction of travel of the HCS 1101 so as to bring the HCS 1101 to a stop. Then, the MF acting upon the HCS 1101, may cause the HCS to being to travel towards the ends 1132 of the links 1120-*x* thus, completing the cycle. A user or controller may repeat acts A through I so as to cause the HCS 1101 to travel between ends of the links 1120-*x*.

Figures 12A, 12B, 12C:
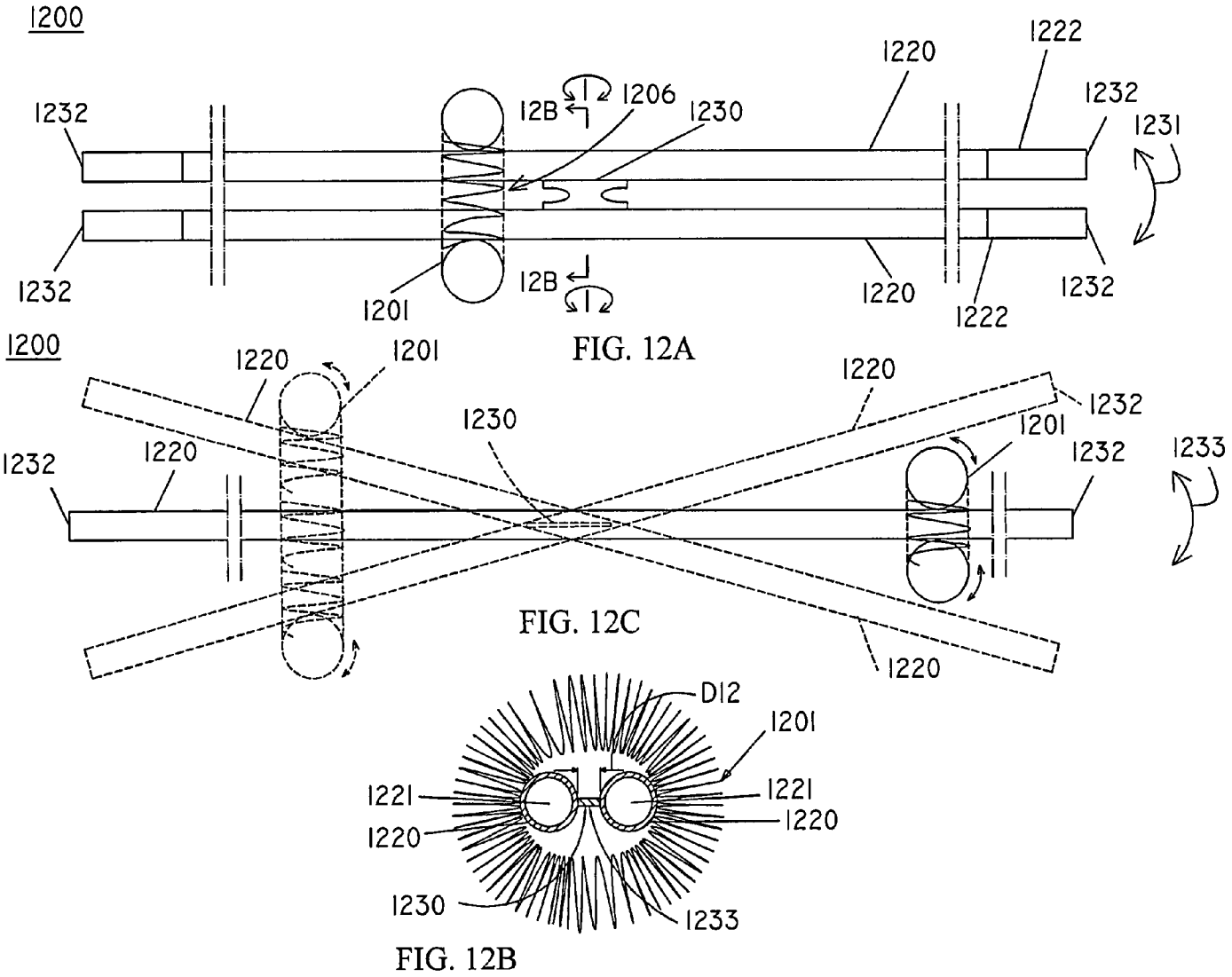
FIG. 12A is a top view of a portion of an apparatus in accordance with embodiments of the present system.
FIG. 12B is a cross sectional view of a portion of the apparatus taken along lines 12B-12B of FIG. 12A in accordance with embodiments of the present system.
FIG. 12C is a side view of a portion of the apparatus in accordance with embodiments of the present system.

FIG. 12A is a top view of a portion of an apparatus 1200 in accordance with embodiments of the present system. The apparatus 1200 is similar to the apparatus 1100 and may include an HCS 1201 which is similar to the HCS 101 and is situated about links 1220-1 and 1220-2 (generally 1220-*x*). However, the apparatus 1200 includes an elastic coupler 1230 which couples the links 1220-*x* to each other so as to locate the links 1220 relative to each other in, for example, a scissor-like manner in one more axes. Accordingly, when ends 1232 of the links 1220-*x* are spread apart from each other, the elastic coupler 1230 may cause couple the links 1220-*x* to each other so that they to rotate relative to each other about one or more axes defined by the elastic coupler 1230. The HCS 1201 may be similar to the HCS 101 and forms a closed loop having an opening 1206 through which the links 1220-*x* pass.

Handles 1222 suitable for grasping by a user may be included at one or more of the ends 1232, if desired. The handles 1222 may be removable or fixed and/or may be attached to or formed integrally with the links 1220, if desired FIG. 12B is a cross sectional view of a portion of the apparatus 1200 taken along lines 12B-12B of FIG. 12A in accordance with embodiments of the present system. The elastic coupler 1230 may be attached to one or more of the links 1220-*x* using any suitable method. For example, the elastic coupler 1230 may be molded integrally with the one or more of the links 1220-*x* (e.g., using any suitable process such as a two-shot molding process, etc.) or may be coupled to one or more of the links 1220-*x* using, for example, any suitable attachment method such as such as a friction fit, hook and loop type fastening, a rail, etc. Further, it is envisioned that the elastic coupler 1230 may be user replaceable and/or repositionable relative to one or more of the links 1220-*x*. Accordingly, a user may replace a torn or damaged elastic coupler 1230 and/or may reposition the elastic coupler 1230 such that it is located symmetrically and/or asymmetrically relative to a length of the bodies one or more of the links 1220-*x*. Further, the force constant of the elastic coupler 1230 may be adjusted as desired to adjust a biasing force of the elastic coupler 1230.

Moreover, it is envisioned that a user may select different couplers (e.g., elastic, etc.) from, for example, a plurality of couplers, which may for example, have different construction so as to vary characteristics of the elastic coupler 1230, if desired. For example, the couplers may have different degrees of freedom, different biasing, and/or different lengths (e.g. so that a distance D12 between the links 1220-*x* may be adjusted). With regard to the distance D12 between the links, this may be 1120-*x* may be controlled by using, for example, different sized center portions 1233 or by using an adjustable connection method which may vary this distance. The links 1220-*x* may include a hollow center section 1221. Further, although substantially linear links 1120-*x* are shown, the links 1220-*x* may have other shapes and/or sizes, if desired. The links 1220-*x* may, for example, be formed from any suitable material such as a plastic (e.g., a polyvinylchloride (PVC) pipe), a metal, a wood, a polymer, etc.

FIG. 12C is a side view of a portion of the apparatus 1200 in accordance with embodiments of the present system. The links 1220-*x* may be rotated about the elastic coupler 1230 as illustrated by arrow 1233. The elastic coupler 1230 may provide a biasing force to return the links 1220-*x* to a desired position or position range relative to each other, if desired. However, in other embodiments, it is envisioned that the elastic coupler 1230 may provide little biasing force when the links 1220-*x* are within certain ranges of motion. The apparatus 1200 may be used similarly to the apparatus 1100.

Figure 13:
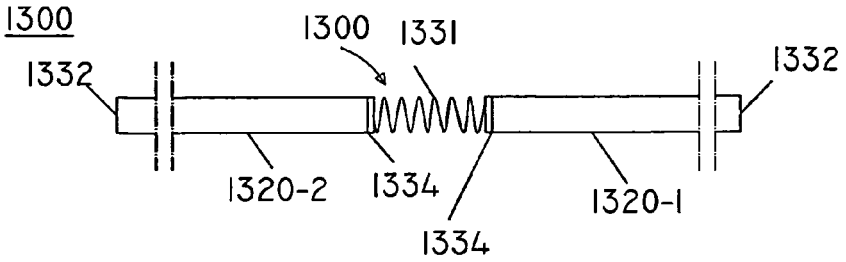
FIG. 13 is a side view of a portion of an apparatus in accordance with embodiments of the present system.

FIG. 13 is a side view of a portion of an apparatus 1300 in accordance with embodiments of the present system. The apparatus 1300 may include links 1320-1 and 1320-2 (generally 1320-*x*) each having first and second ends 1332 and 1334, respectively, and which may each be similar to the links 1220-*x*. However, ends 1334 of the links 1320-*x* are coupled to each other using a coupler 1330 such as a helical spring 1331. The length of the coupler 1330 may allow the user to bend the apparatus 1300 in a "U" shape with the coupler 1330 at the middle (or bottom) of the "U."

Figure 14A:
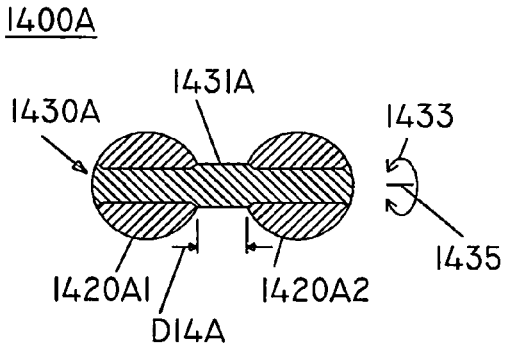
FIG. 14A is a cross section view of a portion of an apparatus in accordance with embodiments of the present system.

However, it is also envisioned that other types of couplers may be used. For example, FIG. 14A is a cross section view of a portion of an apparatus 1400A in accordance with embodiments of the present system. The apparatus 1400A may include a coupler 1430A having a simple hinge pin 1431 which couples first and second links 1420-A1 and 1420-A2 (generally 1420-A) together. The apparatus 1400A may function similarly to the apparatus 1100 and, other than the coupling method, the links 1420-A may be similar to the links 1120-*x*. The hinge pin 1431 defines an axis 1435 about which the links 1420-A may rotate about relative to each other as illustrated by arrow 1433. The hinge pin 1431 may be formed integrally with, or separate from, one or more of the links 1420-A, and, may provide for rotation substantially about a single axis, if desired. One or more of the links 1420-A may include an opening to receive the hinge pin 1431. The hinge pin 1431 may be held in position relative to the links 1420-A using any suitable method such as by using saddles, clips, a friction fit, etc. Further, the hinge pin 1431 may be formed integrally with one the links 1420-A and hingedly attached to the other of the links 1420-A.

Figure 14C:
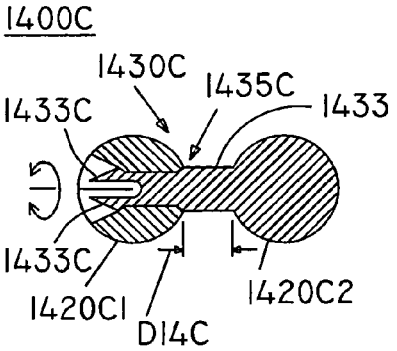
FIG. 14C is a cross section view of a portion of an apparatus in accordance with embodiments of the present system.
Figure 14B:
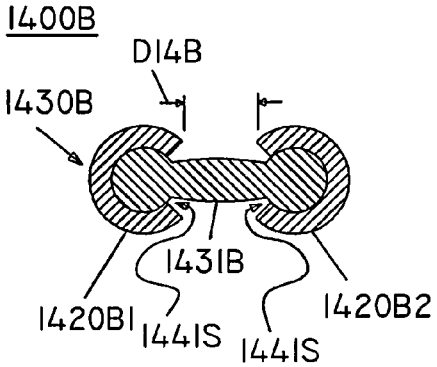
FIG. 14B is a cross section view of a portion of an apparatus in accordance with embodiments of the present system.

FIG. 14B is a cross section view of a portion of an apparatus 1401B in accordance with embodiments of the present system. The apparatus 1401B may be similar to the apparatus 1401A. However, the apparatus 1401B may include a coupler having one or more of a ball-and-socket joint (two are shown in the present example) or other similar joint. Accordingly, the coupler may include a rod 1439 having ball-type ends 1441B on one or more ends thereof. The ball-type ends 1441B are coupled in corresponding sockets 1441S which may be situated within links 1420C of the apparatus 1401B.

FIG. 14C is a cross section view of a portion of an apparatus 1401C in accordance with embodiments of the present system. The apparatus 1401C may be similar to the apparatus 1401C. However, a coupler 1430C may include a hinge pin 1431C which is formed integrally with link 1420C2 and is inserted into an opening 1435C in a second link 1420C1 so as to define an axis about which the second link 1420C1 may rotate about. The hinge pin 1431C may be formed from a resilient material and may include engagement members 1433C which may engage a flange 1437C of the second link 1420C1. The length of the hinge pin 1431C may be adjusted to adjust a distance between the first and second links 1420C2 and 1420C1, respectively. The hinge pin 1431C is a self-latching hinge pin.

Figure 14D:
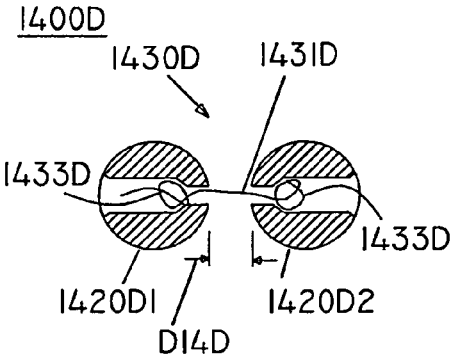
FIG. 14D is a cross section view of a portion of an apparatus in accordance with embodiments of the present system.

FIG. 14D is a cross section view of a portion of an apparatus 1401D in accordance with embodiments of the present system. The apparatus 1401D may include a coupler 1437 having an elastic tube 1437 in accordance with embodiments of the present system. The apparatus 1401D may be similar to the apparatus 1401A. However, the apparatus 1401D may include a coupler 1430C including one or more elastic tubes such as the elastic tube 1437 which may extend through one or more openings 1451 in links 1420D. End regions of the elastic tube may include a restraining device such as a knot 1453 which may contact an inner flange of corresponding ones of the openings 1451. This configuration may be repeated in other locations along a length of one or more of the links 1420 so that the couplers 1430D may provide a desired biasing force to twisting movement, if desired. Further, the couplers 1430D may be matched to other coupling methods, if desired.

However, other methods of situating the hinge pin relative to the links are also envisioned.

Further, it is envisioned that a resilient biasing member such a spring may be coupled to the links to urge the links into a desired position relative to each other and/or to the hinge. For example, the biasing member may urge the links substantially to a desired angle relative to each other (e.g., 20 degrees see, $\alpha$). It is also envisioned that embodiments of the apparatus may include a damper to coupled to the links 1520 (and/or the hinge 1530) so as to provide a damping force to dampen movement of the links 1520 relative to each other. The damper may include a friction-of hydraulic-type damper. Moreover, it is also envisioned that the hinge may be located at an end of each of the links such that the links may be configured in a "V" like manner and extend outward from the hinge.

Figure 15:
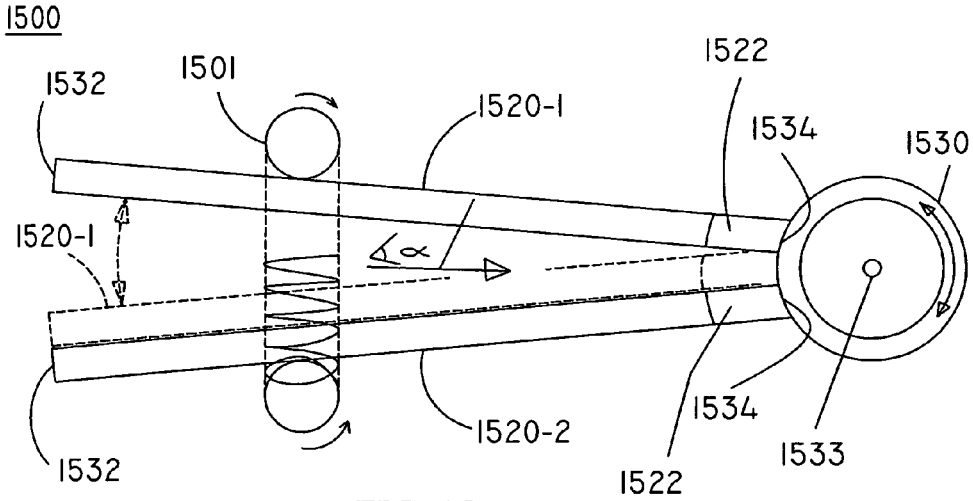
FIG. 15 shows a side view of a portion of an apparatus including an HCS and links in an open position in accordance with embodiments of the present system.

FIG. 15 shows a side view of a portion of an apparatus 1501 including an HCS 1501 and links 1520-1 and 1520-2 (generally 1520-*x*) in an open position in accordance with embodiments of the present system. The HCS 1501 may be similar to the HCS 101. The links 1520-*x* may be coupled together using a coupler which uses any suitable method such as a polymer coupling (e.g., a live hinge, etc.), a spring hinge 1530, a floating hinge, etc. The coupler such as the spring hinge 1530 may couple the links 1520 and provide a biasing force to, for example, bias the links 1520 in a desired position/orientation such as an open position (as shown by the solid lines (e.g., see angle alpha ($\alpha$)), a closed position (e.g., see dotted lines)), etc. The biasing force of the coupler may be adjusted as desired. In use, a user may hold the links 1520-*x* at a desired location such as at distal ends 1532 of each link 1520-*x*, at ends 1534 of each coupler, etc., so as to apply a force to open or close the links (e.g., increase or decrease angle $\alpha$). Accordingly, the by opening or closing the links 1520-*x* distances between adjacent portions of the links 1520-*x* may be controlled to cause the HCS 1501 to move in a desired direction. With regard to the spring hinge 1530, this hinge may include a coiled spring and/or a restrainer link 1526 such as is common on hand-grip-type exercise equipment. A restrainer link 1526 may be coupled to the opposite sides of the hinge coil and/or to the links 1520-*x* to control maximum values of angle ($\alpha$) and thus, control the maximum separation between the links 1520-*x* at various portions such as at the distal ends 1532. The maximum separation of the links 1520-*x* should set such that the HCS 1501 is not damaged by due to overstretching about the links 1520-*x* during use. A flexible tube such as a flexible silicon tubing or the like may be situated over at least part of the spring hinge 1530, if desired.

Figure 16:
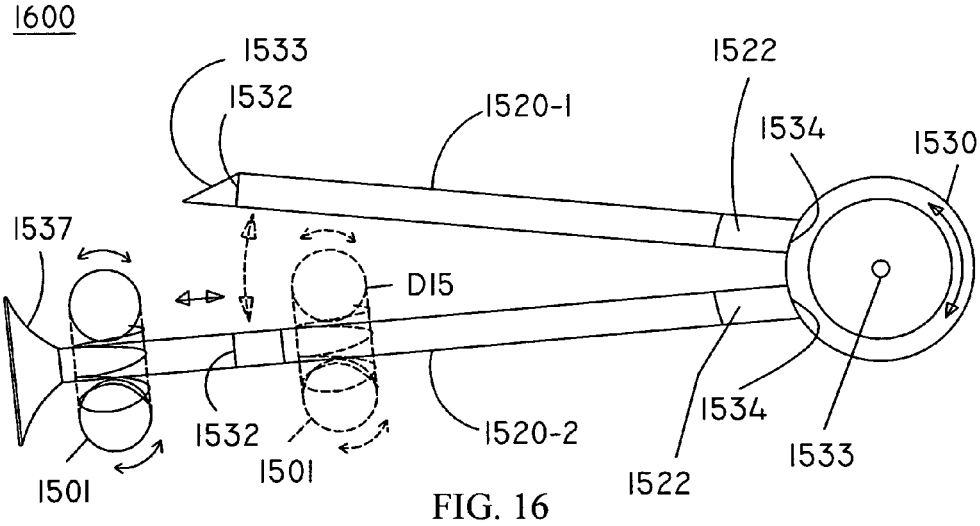
FIG. 16 shows a side view of a portion of the apparatus in a closed position and including with shaped end portions in accordance with embodiments of the present system.

FIG. 16 shows a side view of a portion of the apparatus 1501 in a closed position and including with shaped end portions in accordance with embodiments of the present system. The apparatus 1601 is essentially similar to the apparatus 1501. However, the corresponding links 1520-1 and 1520-2 may include end portions 1621 and 1623, respectively, coupled thereto so as to change a path, shape, size, and/or length of the corresponding link 1520-*x* (e.g., in one or more axes). The link 1520-1 with the end portion 1621 attached thereto will be referred to as a link 1620-1 and the link 1520-2 with the end portion 1623 attached thereto will be referred to as a link 1620-2. The end portions 1621 and 1623 may have various shapes, sizes and/or lengths (e.g., in one or more axes) as may be desired. For example, end portion 1621 may be shorter than the end portion 1623 and may include a ramp 1632 at an end. The positions of the ends of one or more of the links 1620-*x* may be adjusted relative to each other so that the HCS 1601 may transition from extending about two or more links 1620-*x* (e.g., at position A) to extending about one or more the other of the links 1620-*x* (e.g., at position B) (e.g., at location C). The ramp 1632 may aid in a transitioning process as the HCS 1601 rides on or off the link 1620-1. Accordingly, the ramp or other smoothed shape may provide a linear path as opposed to a stepped path, which although envisioned, may cause the HCS 1601 to be jarred unnecessarily during transition on or off of a corresponding link 1620-*x* of the one or more of the links 1620-*x* during use.

Further, during use, when the HCS 1601 does not extend about the link 1620-1 (e.g., at location A), if an end portion of this link 1620-1 (e.g., the ramp 1623) is moved away from the link 1620-2 by a sufficient distance, the HCS 1601 may travel past location C without transitioning to the link 1620-1 so as to ride upon both of the links 1620-1 and 1620-2 as it would do when the link 1620-1 is adjacent to or in close proximity to the link 1620-2 as the HCS 1601 travels in a direction indicated by arrow 1631. This is better illustrated with reference to FIG. 17 which shows the apparatus 1501 of FIG. 1601 in an open position. In the open position the HCS 1601 may travel along the link 1620-2 that it rides upon. Thereafter, the apparatus 1601 may be closed (when the HCS 1601 is in a proper position such as position B of FIG. 6) and the coil 1600 may be transitioned to ride back upon both of the links 1620-1 and 1620-2, if desired. Accordingly, depending upon rides upon one or both of the links 1620-1 and 1620-2, primary motive forces to move the HCS 1601 may be shifted from a biasing motive force (e.g., due to inclination between the links 1620-1 and 1620-2 e.g., as may occur when the coil 1600 rides upon both of the links 1620-*x*) to a gravitational motive force (e.g., as may occur when the coil 1600 rides upon a single link such as the link 1620-2 as shown, which may be tilted so that gravity may pull the HCS 1601 along the link.

Thus, a user or a controller may manipulate the links 1620-*x* relative to each other as the HCS 1601 extends about and travels along one or more of the links 1620-*x* so as to control whether the HCS 1601 rides upon one or more of the links 1620-*x*, thus, adding to amusement of a user and/or viewer. Further, the user may manipulate the links 1620-*x* relative to each other so as to control angles and/or distances between the links 1620-*x* which may be used to transfer energy (potential and/or kinetic) to or from the HCS 1601. For example, by transferring energy (e.g., potential energy) to the HCS 1601, this energy provide a motive force to HCS 1601 which may cause the HCS 1601 to travel relative to the links 1620-*x* and, thus, be converted to kinetic energy as helical spring travels and/or rotates about its poloidal axis (e.g., in see theta θ). The kinetic energy may then be transferred back to potential energy, etc.

Figure 17:
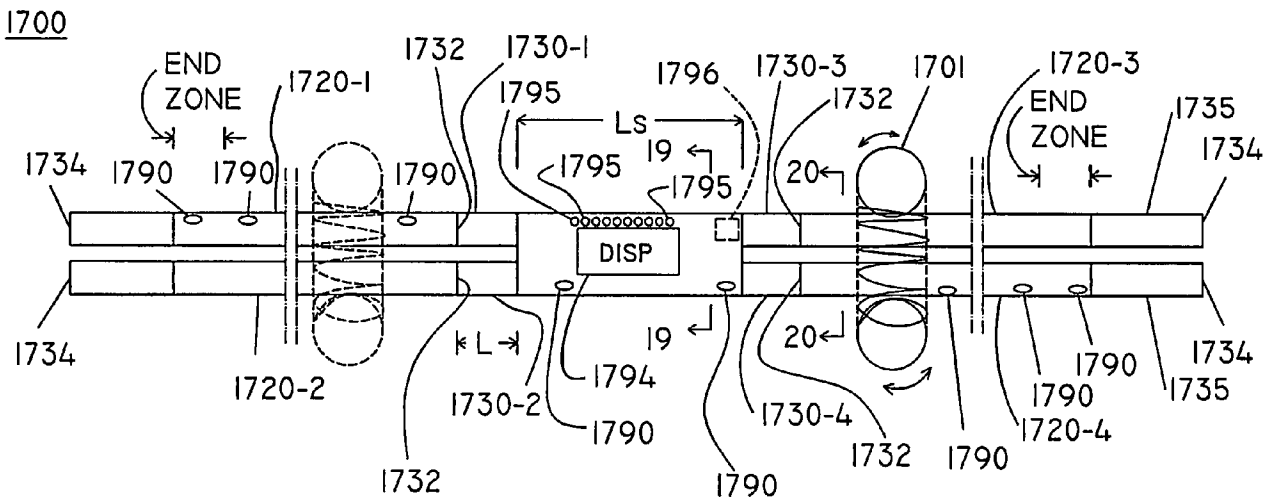
FIG. 17 shows a top view of a portion of an apparatus including an HCS, a center link, and links in a closed position in accordance with embodiments of the present system.

FIG. 17 shows a top view of a portion of an apparatus 1700 including an HCS 1701, a center link 1721, and links 1720-1 through 1720-4 (generally 1720-*x*) in a closed position in accordance with embodiments of the present system. The apparatus 1701 may be suitable for use by multiple users. For example, a first user may manipulate links 1720-1 and 1720-2 (e.g., a first link pair) while a second user may manipulate links 1720-3 and 1720-4 (e.g., a second link pair) so as to control movement of the HCS 1701 along a path defined by the first and/or second link pairs across the apparatus 1700. Each of the links 1720-1 through 1720-4 may have proximal ends 1732 and distal ends 1734 and, for the sake of clarity may be similar to each other. The proximal ends 1732 of one or more of the links 1720-1 through 1720-4 may be coupled to the center link 1721 via corresponding couplers 1730-1 through 1730-4 (generally 1730-*x*), respectively. The couplers 1730-*x* may include a live hinge formed from an elastic material which may be coupled to (e.g., by molding, bonding, adhesives, friction fits, screw fits, etc.) the center link 1721 to distal ends 1732 of corresponding ones of the links 1720-*x*. The couplers 1730-*x* may have a length (L) and cross section (e.g., size, shape, etc.) sufficient to provide a desired amount of freedom of movement and/or biasing to each of links 1720-*x*. For example, it is envisioned that each of the links may have a range of motion of between 0 and approximately 90 degrees as illustrated by P. Further, if desired, each of the links 1720-*x* may have several degrees of freedom and may move one or more planes. With regard to cross sections, each of the couplers 1730-*x* may have a cross section with a similar shape and/or size as a shape and/or size, respectively, of a cross section of an adjoining link 1720-*x* at, for example, the proximal end 1732 of a corresponding link 1720-*x*. However, it is also envisioned that the couplers 1730-*x* may other cross sections such as varying cross sections, hollow cross sections, etc. Further, it is envisioned that portions of adjacent couplers 1730-*x* may be formed integrally with each other. For example, the couplers 1730-*x* may be joined, at least partially, to each other at an end which is adjacent to the center link 1721. The couplers 1730-*x* may be molded to the center link 1721 and to one or more of the adjacent ones of the links 1720-*x*. However, in alternative embodiments, it is envisioned that other types of couplers 1720-*x* may be used such as tubing (e.g., rubber, synthetic rubber, latex, accordion shaped, etc.), coiled springs (e.g., as used on exercise bars to couple two links), hinges, ball-and-socket joints, rod-end bearings, linkage-bars (e.g., Igubal™ type by IGUS inc.), etc. The elastic couplers 1730-*x* may include a biasing element such as a spring integrated within an elastic body of the elastic coupler to provide additional rigidity, if desired. The center link 1721 may include one or more cavities configured to hold, for example, batteries, a user interface (UI) (e.g., a display 1794 (e.g., an organic LED (OLED), a liquid crystal display (LCD), a touchscreen display, etc.), light emitting diodes (LEDs), 1795, a speaker, a entry/selection keys (hard or soft), etc.), the controller 1996, the transmitter/receiver, etc.

One or more of the links 1720-*x* and/or the center link 1721 may include a telescopic portion so that the corresponding link 1720 or center link 1721 may be extended and/or contracted, as desired. Accordingly, for example, the length of the center link 1721 and/or one or more of the links 1720 may be reduced for storage and/or play, as desired.

The apparatus 1701 may include sensors to determine various characteristics regarding the HCS 1701 and/or orientation of the apparatus 1701 or parts thereof. Accordingly, the apparatus 1701 may include sensors such as magnetic orientation sensors (e.g., gravity sensors, operating in one or more axes), accelerometers (e.g., in one or more axes, etc.), optical sensors, capacitive sensors, proximity sensors, microphones, mechanical switches, etc., which may provide sensor information to the controller 1996. For example, optical type sensors (e.g., infra-red (IR) sensors, etc.), may sense when the HCS 1701 passes over the optical sensor, form corresponding sensor information and provide the sensor information to the controller 1996. Thus, the sensors may provide information indicative of location of the HCS 1701 to the controller 1996. This sensor information may then be processed by the controller 1996 to determine speed, direction, number of repetitions, maximum travel amplitude (e.g., distance with respect to one or more of the links 1720-*x* and/or 1721). However, it is also envisioned that proximity sensors such as those provided by the Microsoft™ Kinect™ system may interface with the apparatus 1701 to provide information related to location of the apparatus 1701, the HCS 1701 (relative to the apparatus 1701), and/or orientation of one or more users, for further processing and/or display on a display of the system. Further, when in embodiments which may include a conductive HCS 1701 (e.g., a steel or metallic plated helical coil spring), capacitive or magnetic proximity sensors may be used to provide sensor information indicative of a location of the HCS 1701 in relation to one or more of the links 1720-*x*, the center link 1700, the couplers 1730-*x*, etc.

Accordingly, in embodiments of the present system, the apparatus 1701 may include, for example, optical, capacitive, mechanical, or other types of sensors to determine location of the HCS 1701 at a given time. For example, the apparatus 1701 may include one or more of optical sensors placed at various locations to sense whether the HCS 1701 has passed over the corresponding sensor 1790 and form corresponding sense information. The sensors may provide their sensed information to a controller 1796 which may then process the sense information received from one or more sensors and determine, for example, various game information (GI) such as one or more of number of repetitions, speed (e.g., at one or more locations such as across the center link 1721), average speed, maximum displacement at a side of the apparatus 1721 (e.g., relative to a length of a corresponding link 1720-*x*), etc. total duration of play, etc.

The controller 1796 may then determine a score (e.g., for one or more players and/or games) and render the score and/or sensor information on a user interface (UI) 1794 which may, for example, include display and/or speaker. The controller 1796 may include one or more processors which may be local and/or remote from each other. Further, the apparatus 1701 may include a transmitter/receiver which may be coupled to the controller and may transmit and/or receive information such as the GI to and/or from a remote device such as a smart phone (e.g., an IPhone™, etc.), a tablet (e.g., an Ipad™), a personal digital assistant (PDA), personal computer, a laptop, a netbook, a gaming device (e.g., a Wii™, an Xbox™, etc.), etc., which may then process the GI and store the GI as well as associated information (e.g., names/identification of users, day/date/time, GI, final scores, etc.). Accordingly, the apparatus and/or the remote device may include an application which may provide a user interface (UI) with which a user may interact and select, for example, game players (e.g., by number (e.g., two players, etc.), by identity (John and Jane, etc.), game skill or play level (e.g., advanced, etc.), game type (speed trap, endurance, etc. in accordance with a predefined rule set), etc. The players may then use the apparatus 1701 to play a selected game (selected from predefined or user defined rules (e.g., speed trap, in the current example)) and information related to game such as GI may be transmitted to the controller for further processing, rendering, and/or storage (e.g., in a memory of the system) for the convenience of one or more users.

With regard to the games, the controller 1794 may obtain game rules from the memory of the apparatus as may be selected by a user or the system. For example, a game rule table. Further, points may be calculated based upon how far the HCS 1701 has traveled along a players link pair. For example, in some embodiments a player may only receive points if the HCS 1701 has traveled to an "end zone" which in some embodiments may be defined as a zone which is closest to the corresponding user or users.

Further, it is envisioned that a dock for a smart phone (e.g., an IPhone™, etc.) may be provided (e.g., on one of the links) such that it does not interfere with operation of the apparatus when, for example, the HCS travels past the smart phone.

Figure 18:
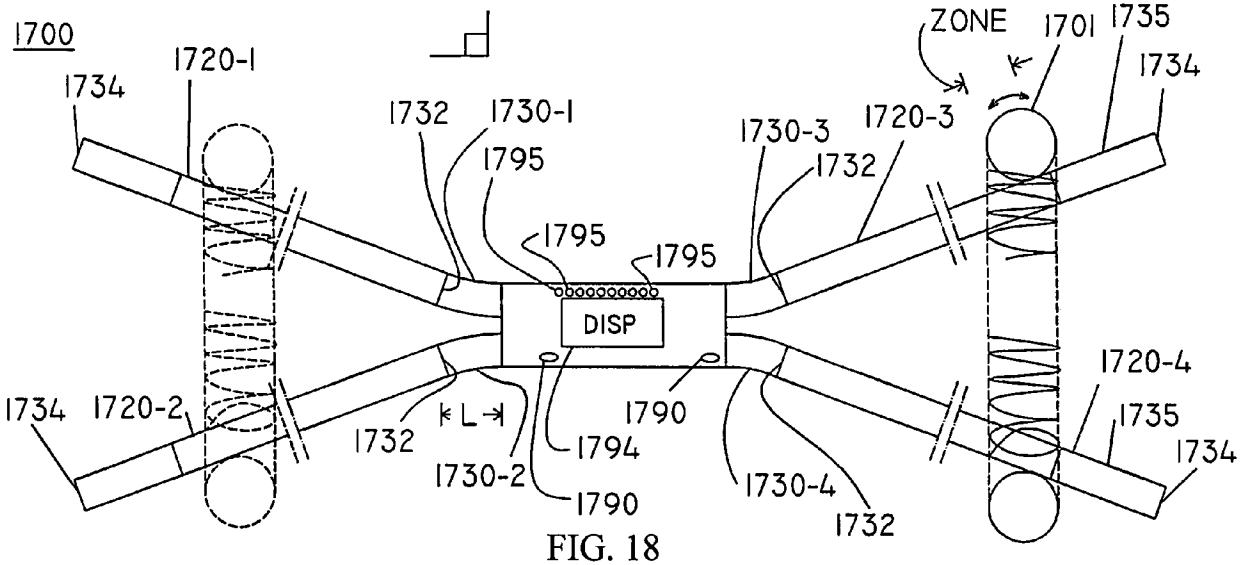
FIG. 18 is a top view of a portion of the apparatus of FIG. 17 in partially open position in accordance with embodiments of the present system.

FIG. 18 is a top view of a portion of the apparatus 1700 of FIG. 17 in partially open position in accordance with embodiments of the present system. In operation, a first user may grasp the handles 1735 of the first link pair and a second user may grasp the second link pair and each user may manipulate the position of their link pair so as to controllably cause the HCS 1701 to travel across the apparatus 1700 or to remain in a desired position relative to the apparatus 1700. The center link 1721 may include a speed trap controlled by the controller 1796 which may determine speed of the HCS 1701 as it passes over a certain distance such as a certain distance over the center link 1721, determine whether the speed is within a desired range, and/or and render results of the determination for the convenience of one or more users. For example, if the controller 1796 determines that the speed of the HCS 1701 is equal to or above a threshold value, the controller 1796 may render the determined speed (e.g., Your speed was 150 feet/sec.) on a display such as the display 1794, may sequentially (e.g., in accordance with a detected direction of travel (or velocity) of the HCS 1701) light the green LEDs, may determine points/outs (e.g., points=100 outs=0) and/or may output a selected sound indicative of the detected speed being equal to or above threshold value. However, if the controller 1796 determines that the speed of the HCS 1701 is less than the threshold value, the controller 1796 may render the determined speed (e.g., "Your speed was 50 feet/sec.") on a display such as the display 1794, may sequentially (e.g., in accordance with a detected direction of travel (or velocity) of the HCS 1701) light the red LEDs, may determine points/outs (e.g., points=0 outs=1), and/or may output a selected sound indicative of the detected speed being less than the threshold value. The threshold value may be set by the user and/or system and may be stored in a memory of the system. Further, the threshold value may be set in accordance with a selected player experience level. For example, assuming that there may be three experience levels beginner, intermediate, the threshold values may equal 10, 20, and 30 (or other threshold values as may be set by the user and/or system), respectively. As shown, the threshold values are arbitrary units for the sake of illustration only. Thus, upon determining that a user has selected an intermediate experience level for a corresponding game to be played, the controller 1796 may obtain from a memory of the system a corresponding threshold value such as 10 in the current example. However, it is also envisioned that the controller may determine an experience level of a user and/or calculate a corresponding threshold value in accordance with the determined experience level. The controller 1796 may calculate total points and/or bonuses, for each user. Further, the controller 1796 may determine a number of outs that a user has accumulated during the current game and when it is determined that a user has accumulated a number of outs (e.g., with the outs being set to 0 at the beginning of a game) which is equal to or greater than a threshold out value (e.g., three), the controller 1796 may end play of the current game, determine a winner (e.g., a user with the most points, etc.), and may render results on a UI such as the display 1794.

Figure 19:
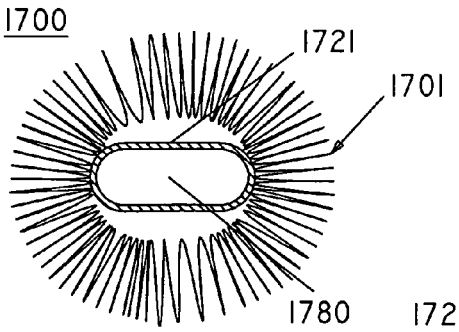
FIG. 19 is a cross-sectional view of a portion of the center link of the apparatus taken along lines 19-19 of FIG. 17 in accordance with embodiments of the present system.

FIG. 19 is a cross-sectional view of a portion of the center link 1721 of the apparatus 1700 taken along lines 19-19 of FIG. 17 in accordance with embodiments of the present system. The center link 1721 may be solid or may include one or more cavities such as cavity 1780 configured to hold, for example, the controller 1796.

Figure 20:
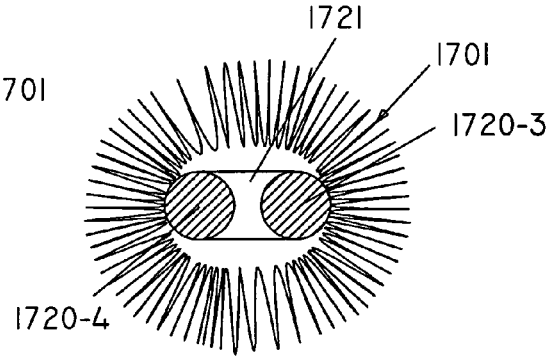
FIG. 20 is a cross-sectional view of a portion of the links of the apparatus taken along lines 20-20 of FIG. 17 in accordance with embodiments of the present system.

FIG. 20 is a cross-sectional view of a portion of the links 1720-3 and 1720-4 of the apparatus 1700 taken along lines 20-20 of FIG. 17 in accordance with embodiments of the present system. The links **1720-*x*** may be solid or may include one or more cavities.

Figure 21:
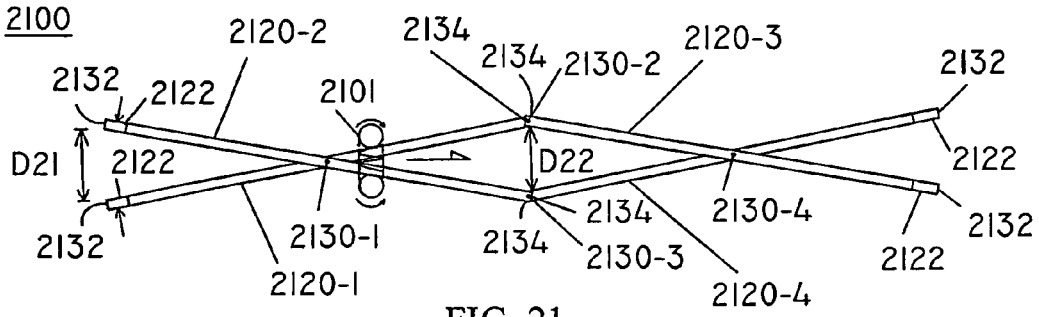
FIG. 21 is a top view of a partially portion of an apparatus in accordance with embodiments of the present system.

FIG. 21 is a top view of a partially portion of an apparatus 2100 in accordance with embodiments of the present system. The apparatus 2100 may include one or more of a HCS 2101 and links 2120-1 through 2120-4 (generally **2120-*x*). The links 2120-*x* are coupled to each other and shown in an open position. Each of the links 2120-*x* includes ends 2132 and 2134 and may have a round cross section. With regard to the first link pair 2103, the links 2120-1 and 2120-2 form a first link pair 2103-land links 2120-3 and 2120-4 form a second link pair 2103-2. The first and second links 2120-1 and 2120-2, respectively, are coupled to each other using any suitable type of coupler such as a pin-type coupler 2130-1 (e.g., a pin-type hinge) although other types of couplers are also envisioned such as an elastic type coupler (e.g., a rubber band such as shown in FIGS. 11A and 11B,), a ball-and-socket type coupler, etc. The coupler 2130-1 may be positioned symmetrically (e.g., substantially in the center of) relative to the first and second links 2120-*x* or may be may asymmetrically located. Accordingly, when the coupler 2130-1 is symmetrically located relative to (a length of) the first and second links 2120-1 and 2120-2, respectively, when the ends 2132 of these links are spread apart from each other by, for example, a distance D21, the ends 2134 of the same links (e.g., the first and second links 2120-1 and 2120-2, respectively) will spread apart by a distance D22 which may be substantially equal to D21. However, when the coupler 2130-1 is asymmetrically located relative to (a length of) the first and second links 2120-1 and 2120-2, respectively, when the ends 2132 of these links are spread apart from each other by, for example, the same distance D21, the ends 2134 of the same links (e.g., the first and second links 2120-1 and 2120-2, respectively) will spread apart by about by a multiple or fraction of D21. Accordingly, amplification or attenuation of distances D21 may be provided by setting a position of the coupler 2130-1**

(e.g., a center coupler) relative to each of the first and second links 2120-1 and 2120-2, respectively. Further, the type of coupler used (e.g., elastic band, ball-and-socket joint, pin hinge, etc.) may be selected in accordance with characteristics of the coupler (e.g., adjustability, biasing/restoring force, degrees of freedom (e.g., one, two, three, etc.), etc.). Each of the links 2120-*x* may include optional handles 2122 suitable for grasping by a user and which may be formed integrally with, or attached to, corresponding ones of the links 2120-*x*, if desired.

The second link pair 2103-2 may be similar to the first link pair 2103-1 and may include third and fourth links 2120-3 and 2120-4, respectively, coupled to each other by a coupler 2130-2 in a similar manner as the first and second links 2120-1 and 2120-2, respectively, are coupled to each other using coupler 2130-1. Ends 2134 of the third and fourth links 2120-3 and 2120-4, respectively, may be correspondingly coupled to the ends 2134 of the first and second links 2120-1 and 2120-2, respectively, using for example, couplers 2130-3 and 2130-4 which may include any suitable coupler (e.g., a pin, an elastic member, etc.) such that movement at the ends 2134 of the first and second links 2120-1 and 2120-2 would be cause a corresponding movement at the ends 2134 of the third and fourth links 2120-3 and 2120-4.

Accordingly, when a user or controller causes the first link pair 2103-1 to move in a scissor-like manner, the second link pair 2103-2 coupled thereto will move in a corresponding motion. Accordingly, by manipulating the ends 2132 of the first link pair 2103-1 in a scissor-like manner, the user may provide a motive force to the HCS 2101 which force may cause the HCS 2101 to move along a path of the first and/or second link pairs 2103-1 and 2103-2, respectively, as desired. Further, momentum and/or kinetic energy of the HCS 2101 may also be used to propel the HCS 2101 in certain areas along the path of the first and/or second link pairs 2103-1 and 2103-2 without receiving additional forces from the link pairs 2103-*x*. Further, potential energy of the HCS 2101 may be converted into kinetic energy and vice versa during use.

One or more of the couplers 2130-1 through 2130-4 may include biasing elements and/or dampers (e.g., to dampen motion, etc.), if desired. The shape and/or size of cross sections of the links 2120 should be set such that the links 2120 do not ride up into a HCS 2101 riding upon the links 2120 during use.

Further, although only two link pairs (e.g., 2103-1 and 2103-2) are shown in FIG. 21, it is envisioned that one or more other link pairs may be coupled to the first and/or second link pairs in a similar to manner to the coupling of the first and second link pairs 2103-1 and 2103-2, respectively, if desired.

Figure 22A:
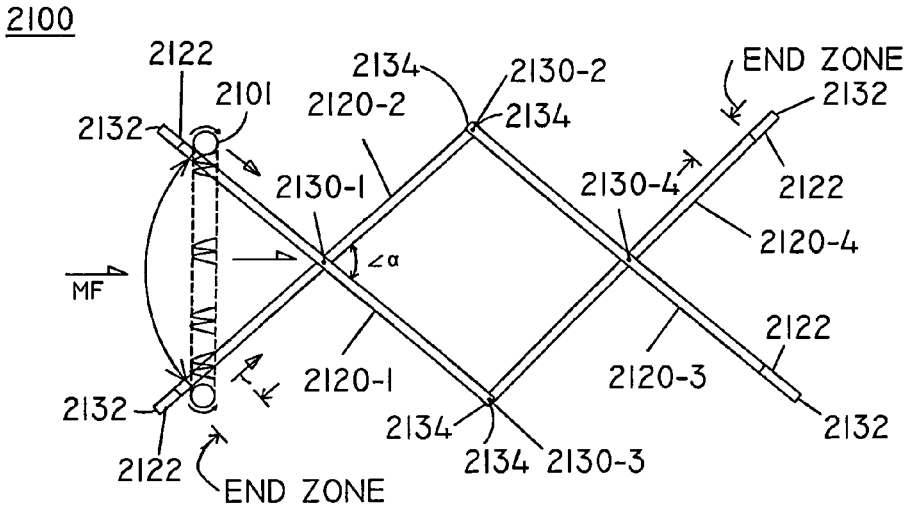
FIG. 22A is a top view of a portion of the apparatus of FIG. 21 in accordance with embodiments of the present system.

FIG. 22A is a top view of a portion of the apparatus 2100 of FIG. 21 in accordance with embodiments of the present system. The apparatus 2100 is shown in an open position in accordance with embodiments of the present system.

Figure 22B:
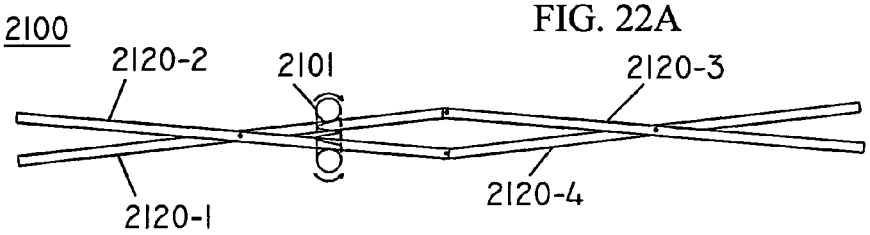
FIG. 22B is a top view of a portion of the apparatus of FIG. 21 in accordance with embodiments of the present system.

FIG. 22B is a top view of a portion of the apparatus 2100 of FIG. 21 in accordance with embodiments of the present system. The apparatus 2100 is shown in a substantially closed position in accordance with embodiments of the present system.

Figure 22C:
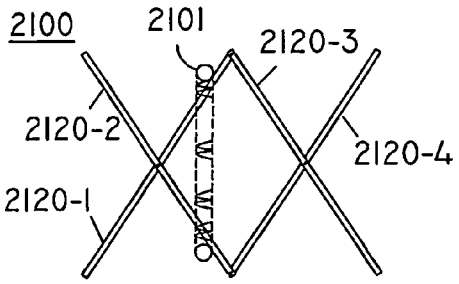
FIG. 22C is a top view of a portion of the apparatus of FIG. 21 in accordance with embodiments of the present system.

FIG. 22C is a top view of a portion of the apparatus 2100 of FIG. 21 in accordance with embodiments of the present system. The apparatus 2100 is shown in a substantially open position in accordance with embodiments of the present system. The angular range of motion of the links may be set as desired and may be limited by methods used to couple the links. The couplers may include elastic elements (such as is used on live hinges) rather than fixed elements such as pins, etc.

In embodiments for the present system using coupled links, the range of motion of the links may be limited by methods used to couple the links.

Figure 23:
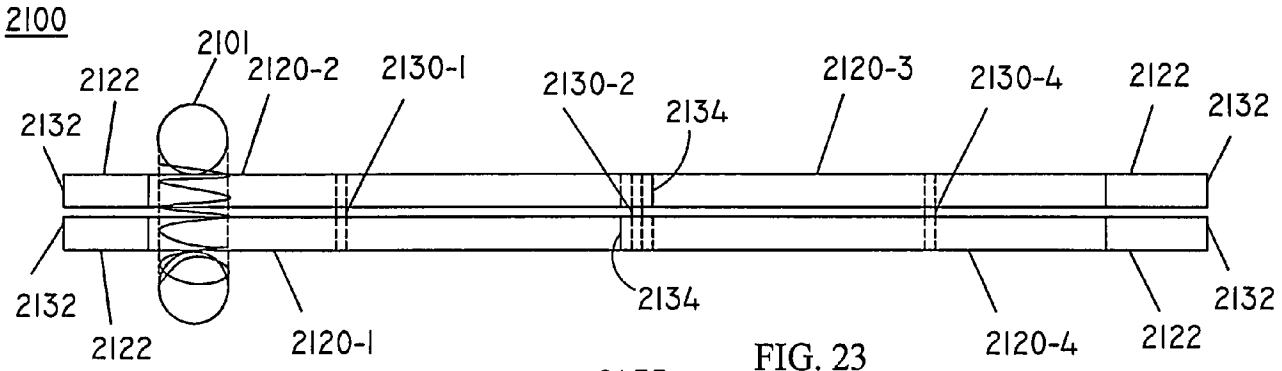
FIG. 23 is a side view of a portion of the apparatus of FIG. 21 in a substantially closed position in accordance with embodiments of the present system.

FIG. 23 is a side view of a portion of the apparatus 2100 of FIG. 21 in a substantially closed position in accordance with embodiments of the present system. One or more of the couplers 2130-*x* may be detachable for storage and/or for removing one of the link pairs 2130-*x* from the other.

Figure 24:
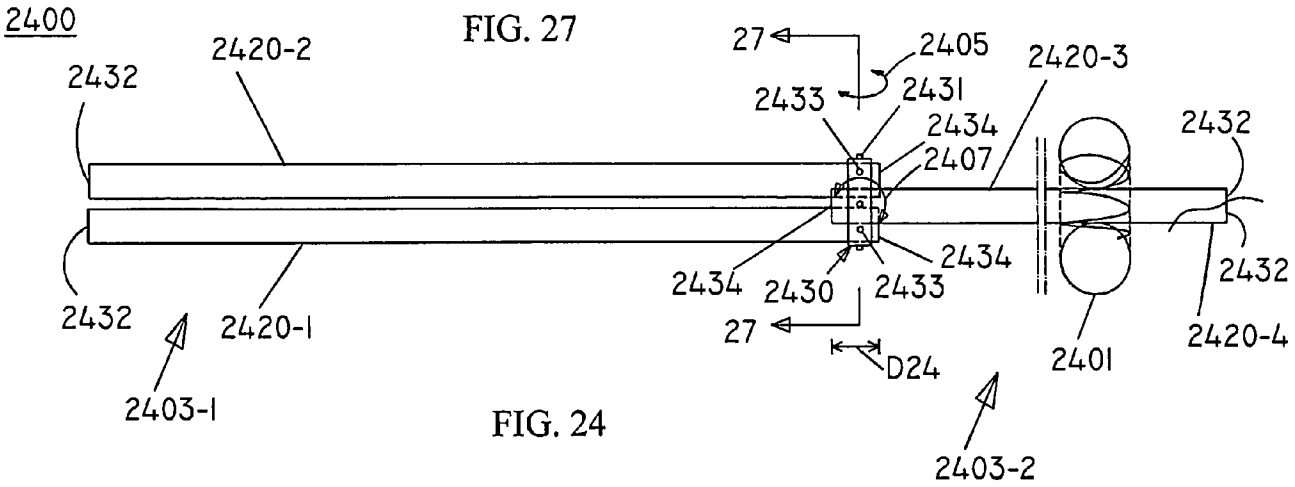
FIG. 24 is a top view of a portion of an apparatus in accordance with embodiments of the present system.

FIG. 24 is a top view of a portion of an apparatus 2400 in accordance with embodiments of the present system. The apparatus 2400 may include one or more of an HCS 2401 and links 2420-through 2420-4 (generally 2420-*x*). The HCS 2401 may be similar to the HCS 101. The links 2400-*x* are shown in a substantially closed position. The links 2420-1 and 2420-2 may form a first link pair 2403-1 and links 2420-3 and 2420-3 and 2420-4 may form a second link pairs 2403-2 (generally 2403-*x*). The links 2420-*x* may be coupled to each other using any suitable type of coupler such as an elastic coupler 2430 (e.g., a rubber band or strap, a live hinge, etc.). However it is envisioned that other types of couplers may be used (e.g., pins, ball-rods, etc.). For the sake of clarity, it will be assumed that each of the links 2420-*x* are constructed in a similar fashion and may have a round cross sections situated between first and second ends 2432 and 2434, respectively. A biasing force of the coupler 2430 may provide sufficient friction to hold the coupler 2430 in position relative to one or more of the links 2420-*x*, and may bias the links 2420-*x* into a substantially closed position relative to each other during use. To positively locate the elastic coupler 2430, one or more of the links 2420-*x* may include a locking element such as a groove, a notch, a button, a protrusion, etc., which may engage a body portion of the coupler 2430. For example, one or more of the links 2420-*x* may include protrusions 2431 which may engage one or more openings 2433 in the elastic coupler 2430 so as to lock the elastic coupler 2430 in position relative to one or more of the links 2420-*x*. However, in other embodiments, it is envisioned that other methods to hold a coupler in position relative to one or more links may be used.

With regard to position of the links 2420-*x* relative to each other, ends 2434 of links 2420-*x* of opposite link pairs 2403-*x* may extend past each other by a distance D24 such that the HCS 2401 can transition from one of the link pairs 2403-*x* to the other without any significant resistance or discontinuity. During use, the first and second link pairs 2403-1 and 2403-2, respectively, may substantially open or close about axes which may be substantially normal to each other. Thus, a first user may act to open/close a link pair 2403-*x* that the first user is substantially operating about, for example, a y axis 2405 and a second user may act to open/close the other link pair 2403-*x* that the second user is substantially operating about, for example, an x axis 2407. However, due to the elasticity of the elastic coupler, the link pairs 2403-*x* may be opened/closed in other axes by a user.

Figure 25:
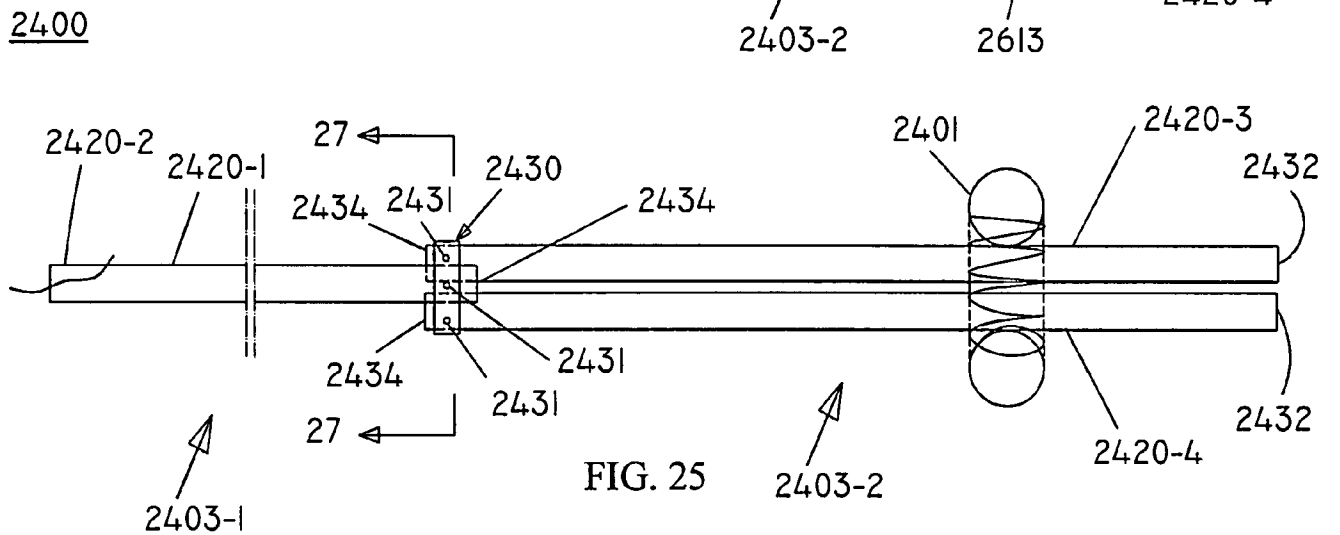
FIG. 25 is a side view of a portion of the apparatus including an HCS and links in a substantially closed position in accordance with embodiments of the present system.

FIG. 25 is a side view of a portion of the apparatus 2400 including an HCS 2401 and links 2420-*x* in a substantially closed position in accordance with embodiments of the present system.

Figure 26:
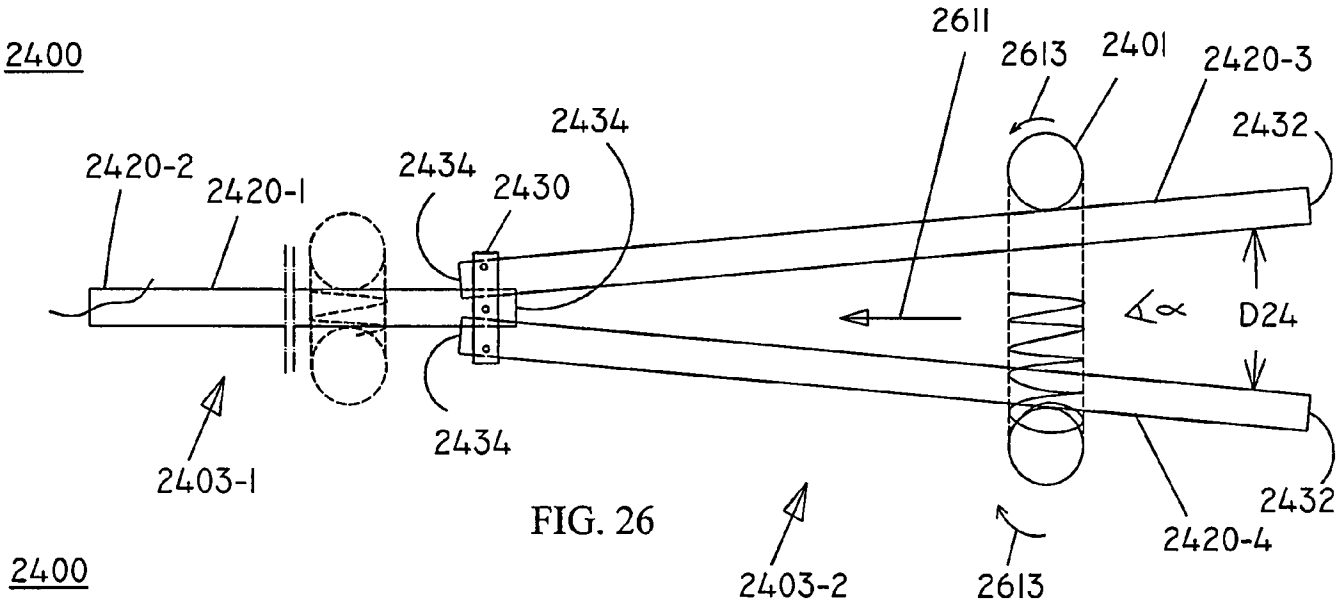
FIG. 26 is a top view of a portion of the apparatus including the HCS and links in a partially open position in accordance with embodiments of the present system.

FIG. 26 is a top view of a portion of the apparatus 2400 including the HCS 2401 and links 2420-*x* in a partially open position in accordance with embodiments of the present system. When the first and second links 2420-3 and 2420-4, respectively, of the second link pair 2403-2 are spread apart from each other at their adjacent ends 2432, a motive force may act to rotate the HCS 2401 about its poloidal axis (as shown by arrow 2613) and may act to cause the HCS 2401 to travel in a direction as illustrated by arrow 2611. Accordingly, potential energy (e.g., due to stretching the HCS 2401) may be converted to momentum of the HCS 2401 as the HCS 2401 contracts. The HCS 2401 may then continue in its motion and pass over the coupler 2430 and onto the first link pair 2403-1. At this time, to slow the motion of helical coil 2401 in the direction of arrow 2611, the first link pair 2403-2 may be controllably opened in a similar manner as the second link pair 2403-2 was opened. By manipulating the first link pair 2403, the HCS 2401 may be brought to a stop, change directions, and travel back towards the second link pair 2403-2. Accordingly, this process may be repeated. In embodiments of the present system, to maximize distance traveled along a link pair 2403-*x*, it may be advantageous to limit opening of a link pair 2403-*x* as the HCS 2401 travels up link pair 2403-*x* until it is necessary to stop the HCS 2401.

Figure 27:
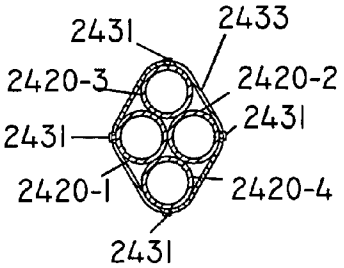
FIG. 27 is a front view of the apparatus taken along lines 27-27 of FIG. 25 in accordance with embodiments of the present system.

FIG. 27 is a front view of the apparatus 2400 taken along lines 27-27 of FIG. 25 in accordance with embodiments of the present system. The elastic coupler 2430 may include openings to receive tabs (or buttons) 2431 which may fixedly located corresponding links 2420 relative to the elastic coupler 2430. The coupler 2430 may be formed from a suitable elastic material (e.g., synthetic rubber, plastic, etc.).

Figure 28A:
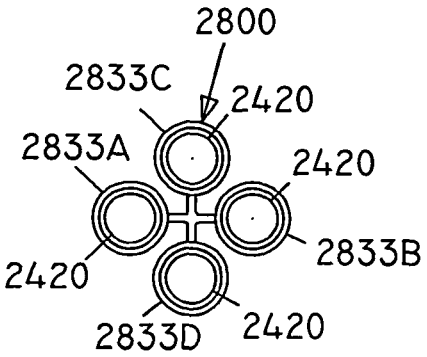
FIG. 28A is a front view of an elastic coupler in accordance with embodiments of the present system.

FIG. 28A is a front view of an elastic coupler 2800 in accordance with embodiments of the present system. The coupler 2800 may be similar to the coupler 1130B of FIG. 11B. However, the elastic coupler 2800 may include a four rings 2833A through 2833E (generally 2833-*x*) coupled to each other by a center portion 2831 rather than two rings of the coupler 1130B. The elastic coupler 2830 may be formed from any suitable elastic material (e.g., plastic, synthetic rubber, natural rubber, latex, etc.) The elastic coupler 2800 may be suitable to couple up to four links such as links 2400 of the apparatus 2400 of FIG. 24. Accordingly, ends 2434 of the links 2420 may be placed corresponding openings 2835 of the rings 2833*x*.

Figure 28B:
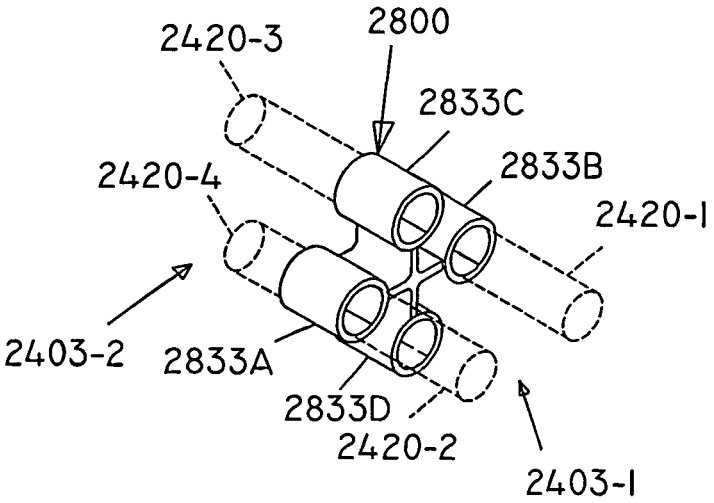
FIG. 28B is a perspective front view of the elastic coupler of in accordance with embodiments of the present system.

FIG. 28B is a perspective front view of the elastic coupler 2800 of in accordance with embodiments of the present system. The elastic coupler may be suitable to receive two link pairs 2403-1 and 2403-2 in, for example, substantially in an arrangement such as shown in FIG. 24. However, other arrangements are also envisioned and may be set by the user. Each of the rings 2833*x* may be configured to provide a biasing force about the links 2420-*x* so as to hold each link 2420-*x* in place using friction.

Figure 29:
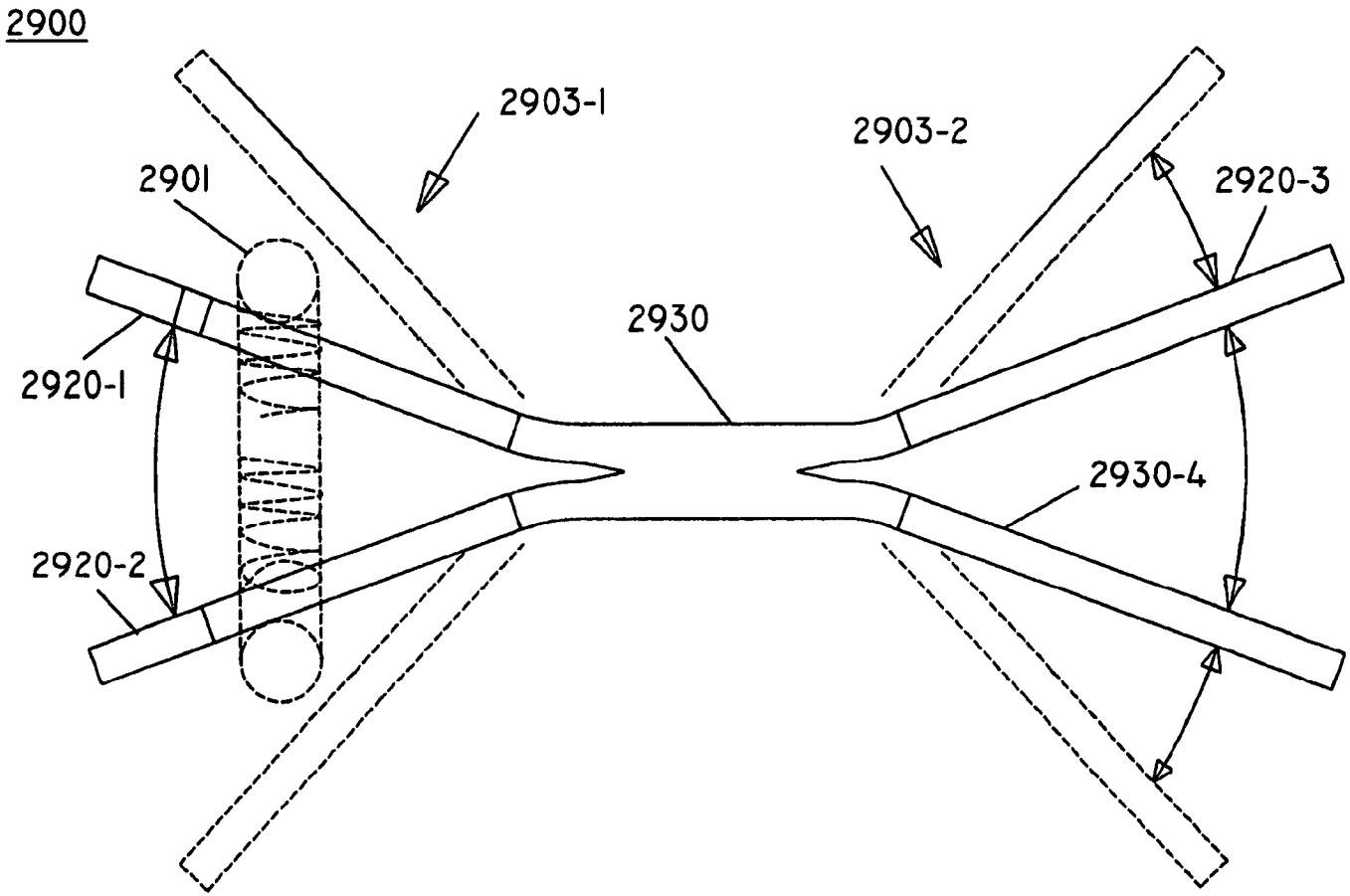
FIG. 29 is a top view of an apparatus in accordance with embodiments of the present system.

FIG. 29 is a top view of an apparatus 2900 in accordance with embodiments of the present system. The apparatus 2900 may include one or more of an HCS 2901, and links 2920-1 through 2920-4 (generally 2920-*x*) coupled to each other using an elastic coupler 2930 which may include a center link 2901 The coupler 2930 may allow the links 2920-*x* to be moved in one or more axes. Accordingly, user's may manipulate the link pairs (e.g., 2920-1 and 2920-2, and 2920-3 and 2920-4) so as to cause the HCS 2901 to move the HCS 2901 (which may be similar to the HCS 101) relative to the apparatus 2900 as per the description of the apparatus 1700. As the apparatus 2900 may operate similarly to the apparatus 1700 of FIG. 17, for the sake of clarity, the reader is directed to the description of the apparatus 1700 for a further description of operation.

Figure 30:
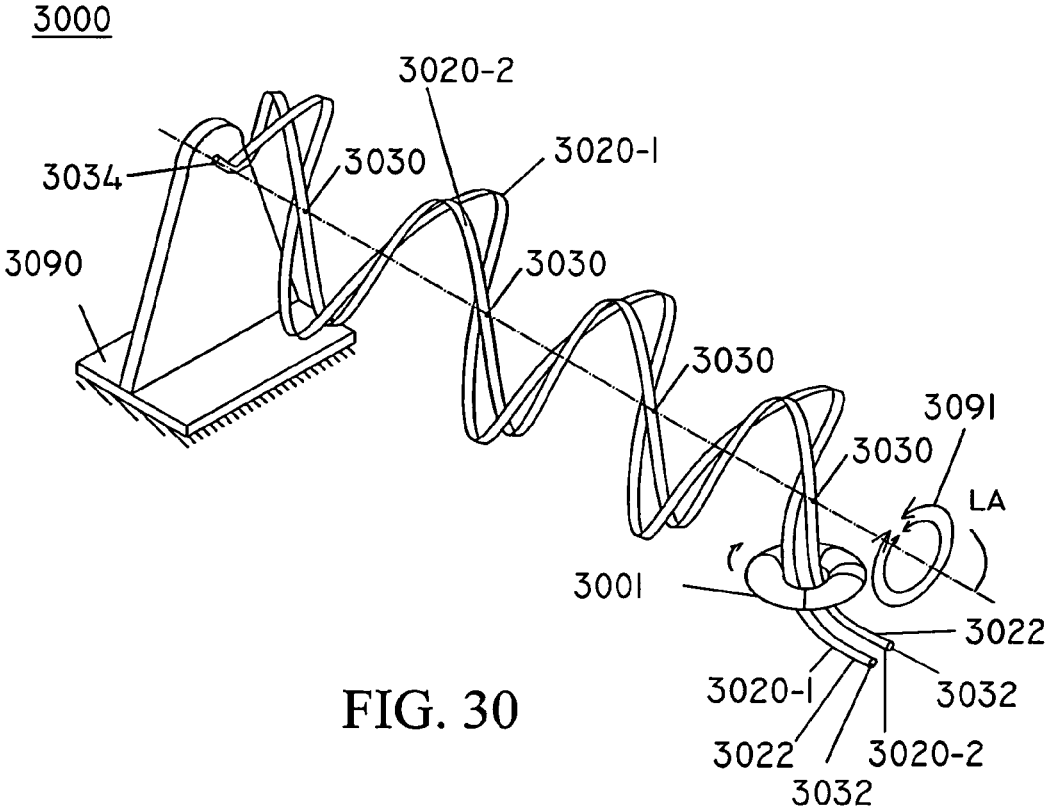
FIG. 30 is a perspective front view of an apparatus in accordance with embodiments of the present system.

FIG. 30 is a perspective front view of an apparatus 3000 in accordance with embodiments of the present system. The apparatus 3000 may include one or more of an HCS 3001 and links 3020-1 and 3020-2 (generally 3020-*x*) coupled to each other using a coupler 3030. The HCS 3001 may be similar to the HCS 101 and may be situated about the links 3020-*x*. The links 3020-*x* may have a round cross section and have a sinusoidal shape in one or more planes (although a sinusoidal shape is shown in a single plane for the sake of clarity). The links 3020-*x* may have first ends 3032 and second ends 3034 and may include handles 3022 suitable for grasping by a user at the first ends 3022. The second ends 3034 of one or more of the links 3020-*x* may be supported by a base such as a base 3090. Although links 3020-*x* having round cross sections and sinusoidal shapes is for the links 3020-*x* is shown, it is also envisioned that the links 3020-*x* may have other shapes and/or cross sections. During use, a user may rotate one or more of the links 3020-*x* about the longitudinal axis (LA) relative to each other so as to impart a motive force upon the HCS 3001 so as to move the HCS 3020 from one end of the links 3020-*x* (e.g., 3032) to the other (e.g., 3034) and/or vice versa.

Figure 31:
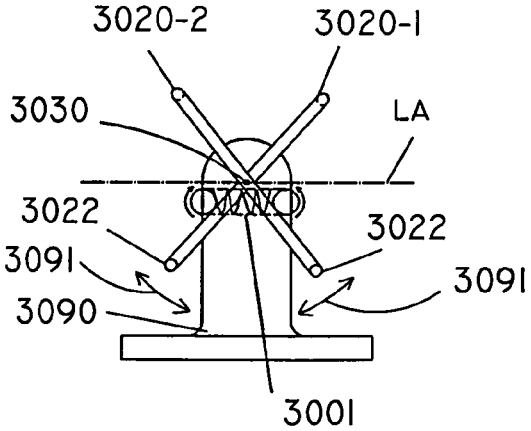
FIG. 31 is a front view of the apparatus in accordance with embodiments of the present system.

FIG. 31 is a front view of the apparatus 3000 in accordance with embodiments of the present system. The base 3090 may extend beyond an outer circumference of the links 3020-*x* such that a supporting surface (e.g., a floor, a table, a bench, etc.) may support the apparatus and not interfere with the links 3020-*x* as they are rotated about the longitudinal axis (LA) as illustrated by arrows 3091. The links 3020-*x* may also be rotated together about the longitudinal axis (LA) if desired.

Figure 32:
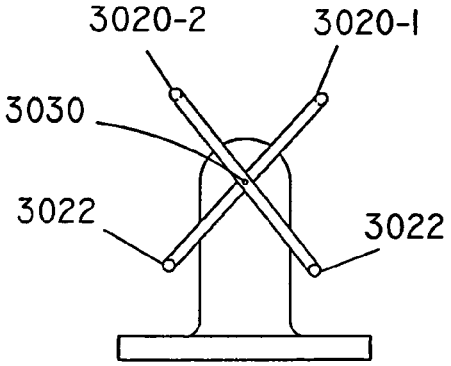
FIG. 32 is a front view of the apparatus in accordance with embodiments of the present system.

FIG. 32 is a front view of the apparatus 3000A in accordance with embodiments of the present system. The apparatus 3000A is substantially similar to the apparatus 3000. However the coupler 3030 is slightly offset from centers of the links 3020-*x*.

Further, although several arrangements of links coupled together are shown, other arrangements are also envisioned.

Figure 33:
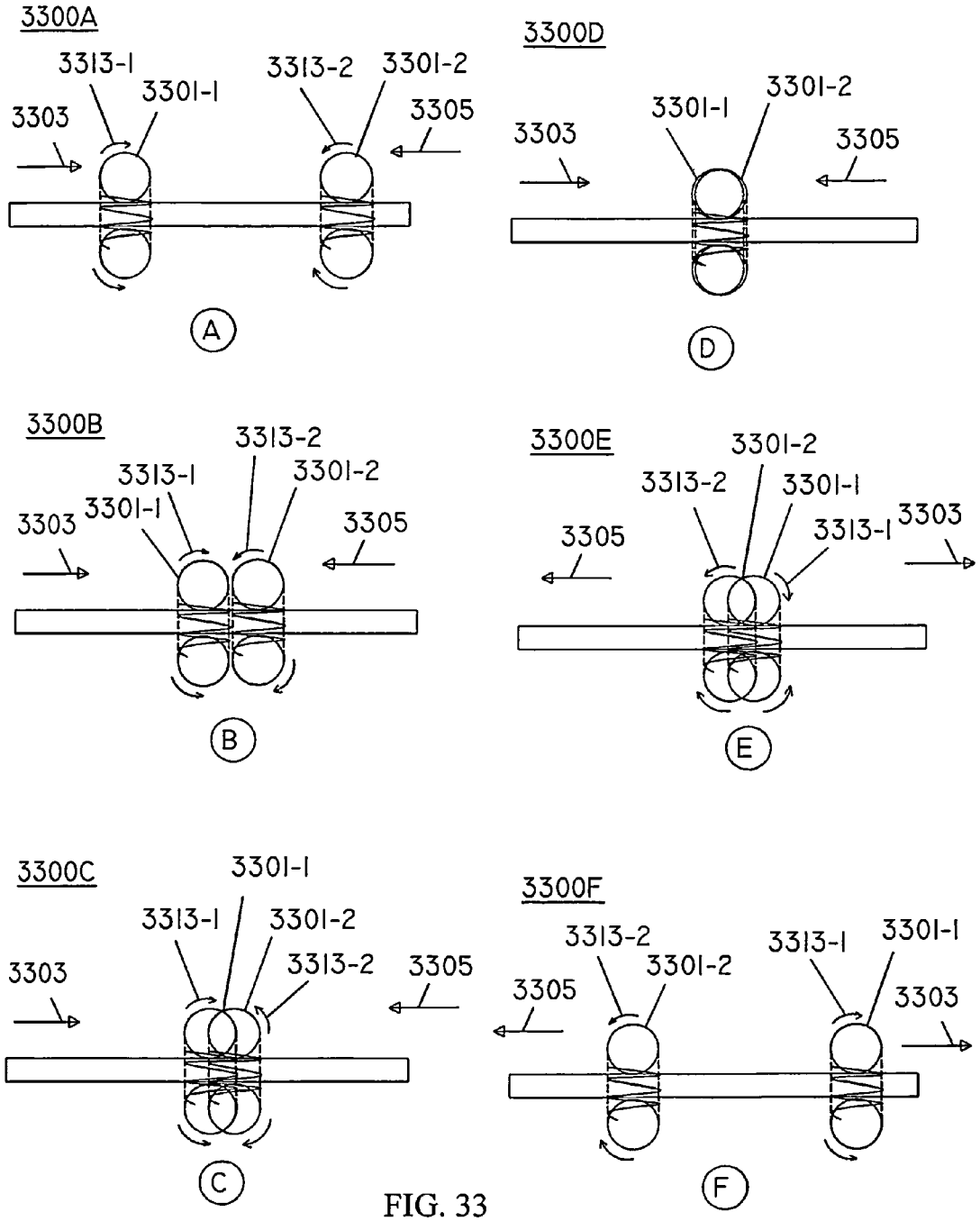
FIG. 33 is a series of side views 3300A through 3300F illustrating two HCSs meshing with each other so as to form a meshed body in accordance with embodiments of the present system.

FIG. 33 is a series of side views 3300A through 3300F illustrating two HCSs 3301-1 and 3301-2 (generally 3301-*x*) meshing with each other so as to form a meshed body in accordance with embodiments of the present system. Further, if, after the meshing both HCSs 3301-1 and 3301-2 continue to in their original direction, they will appear to emerge from opposite sides of the meshed body as if they passed through each other. For example, with reference to view 3300A, two HCSs 3301-1 and 3301-2 are situated about one or more links 3320 (only a single link 3320 is shown) and are traveling in opposite directions as indicated by arrows 3303 and 3305, respectively. Their direction of travel may be assumed to remain the same throughout the views. However, it is also envisioned that their direction of travel may be reversed at any time and the sequence may be reversed. As the HSCs 3301-1 and 3301-2 travel along the path of link 3320, they may rotate about their central axis (CA) as shown by arrows 3313-1 and 3313-2, respectively.

Referring to view 3300B, the two HCSs 3301-1 and 3301-2 continue to travel towards each other as indicated by arrows 3303 and 3305, respectively, and begin to mesh. Referring to view 3300C, the two HCSs 3301-1 and 3301-2 continue to travel in the same direction and mesh further. Referring to view 3300D, the two HCSs 3301-1 and 3301-2 are substantially meshed together (e.g., see 3313). Referring to view 3300E, the two HCSs 3301-1 and 3301-2 begin to emerge from the mesh but on opposite sides of each other. Referring to view 3300F, the two HCSs 3301-1 and 3301-2 are now on opposite sides of each other (c.f., view 3300B). If they continue to travel in their original directions, they will now travel away from each other.

With regard to the HSCs 3301-1 and 3301-2, although they may be substantially the same in other embodiments, it is envisioned that they may have slightly different sizes (e.g., HSC 3301-1 may fit within the turns of HSC 3301-2) and/or number of turns.

Figure 34:
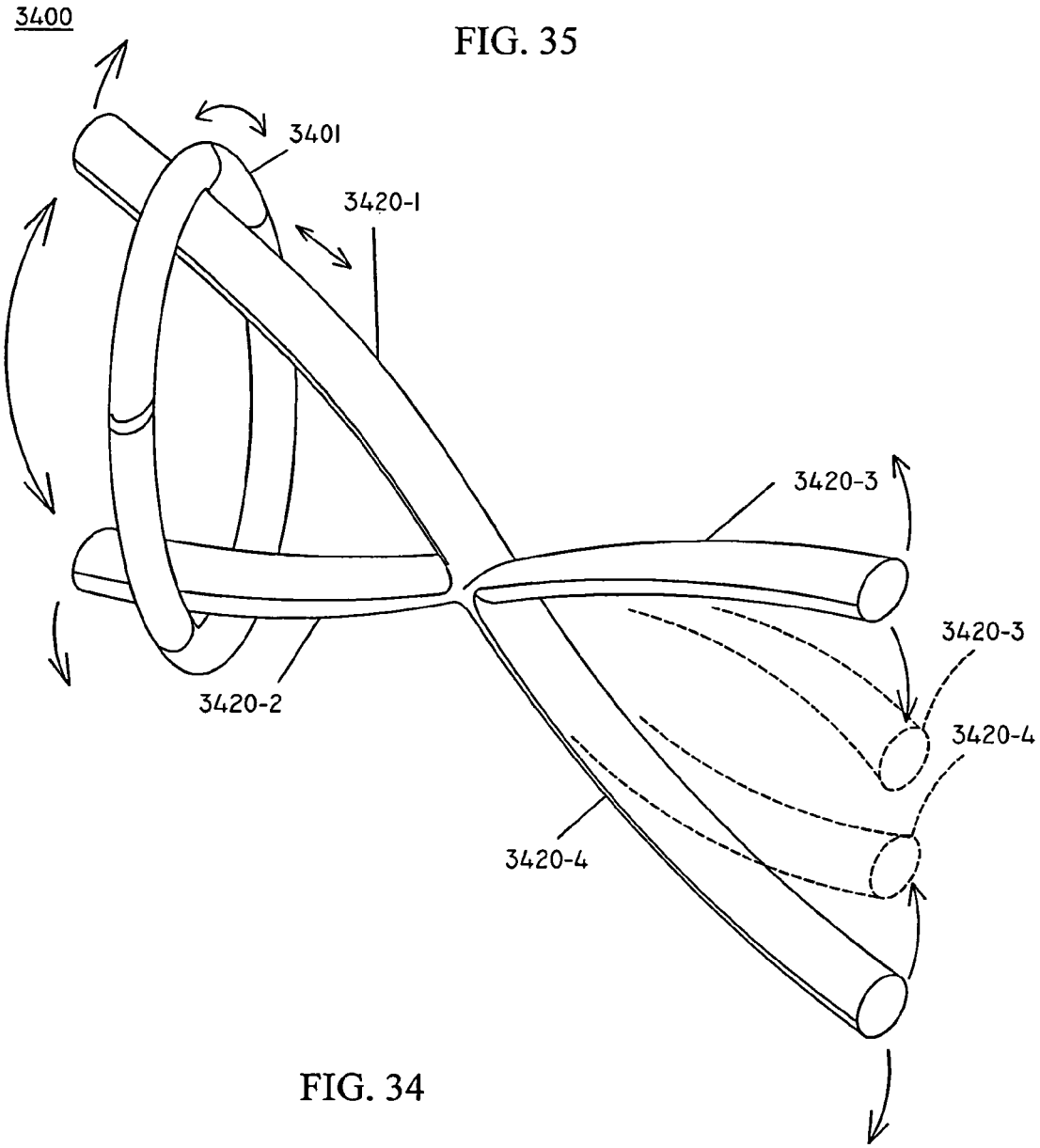
FIG. 34 is a perspective top view of an apparatus in accordance with embodiments of the present system.

FIG. 34 is a perspective top view of an apparatus 3400 in accordance with embodiments of the present system. The apparatus 3400 may include one or more of an HCS 3401 and links 3420-1 and 3420-4 (generally 3020-*x*) coupled to each other. The links 3420-*x* may be formed from a resilient material such as plastic (e.g., fiberglass, etc.) which may counter forces applied by a user. Accordingly, for example, user may exert a force against handles 3422 at ends 3422 of the links 3420-3 and 3420-4 (e.g., a first link pair) so as to force the links 3420-3 and 3420-4 towards each other. Accordingly, the links 3420-3 and 3420-4 may deflect in accordance with the applied force as shown by the dotted lines. Once the force has been release, the links 3420-3 and 3420-4 may then return to its default position (e.g., natural position) as shown. Thus, basically, the links 3420-3 and 3420-4 may act in a spring-like manner. Links 3420-1 and 3420-2 (e.g., a first link pair) may operate in a similar manner when subject to forces exerted thereon by a user. Accordingly, first and second users may grasp the first and second link pairs, respectively, and bend the links as to cause the HCS 3401 to move across the apparatus 3400 as described in other embodiments of the present application. It is envisioned that in some embodiments, one or more of the links 3420-*x* may include a curve in one or more parts thereof such that the corresponding link 3420-*x* may curve away from an adjacent other link 3420-*x*. For example, it is envisioned that links 3420-1 and 3420-2 may arc away from each other at one or more locations such as at distal ends, if desired.

Figure 35:
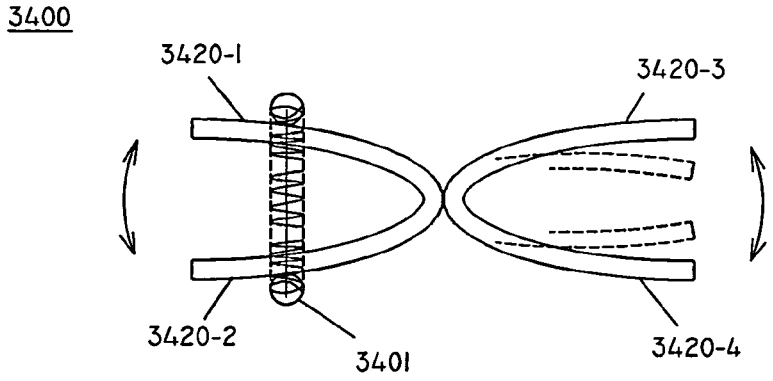
FIG. 35 is a top view of the apparatus of FIG. 34 in accordance with embodiments of the present system.

FIG. 35 is a top view of the apparatus 3400 of FIG. 34 in accordance with embodiments of the present system. The dotted lines illustrate deflection of the links 3420-3 and 3420-4 when subject to force applied by, for example, a user. The links 3420-*x* should be shaped and/or sized such that they do not ride between adjacent turns of the HCS 3401 during use. The HCS 3401 may be similar to the HCS 101.

Thus, it is envisioned that the links may act as biasing members and bend or deflect in response to a force applied thereto and/or return to a default (e.g., natural) or substantially default (e.g., due to internal resistance, damping, etc.) position when the force is no longer applied. Further, it is envisioned that each link may include a plurality of biasing members.

Figure 36:
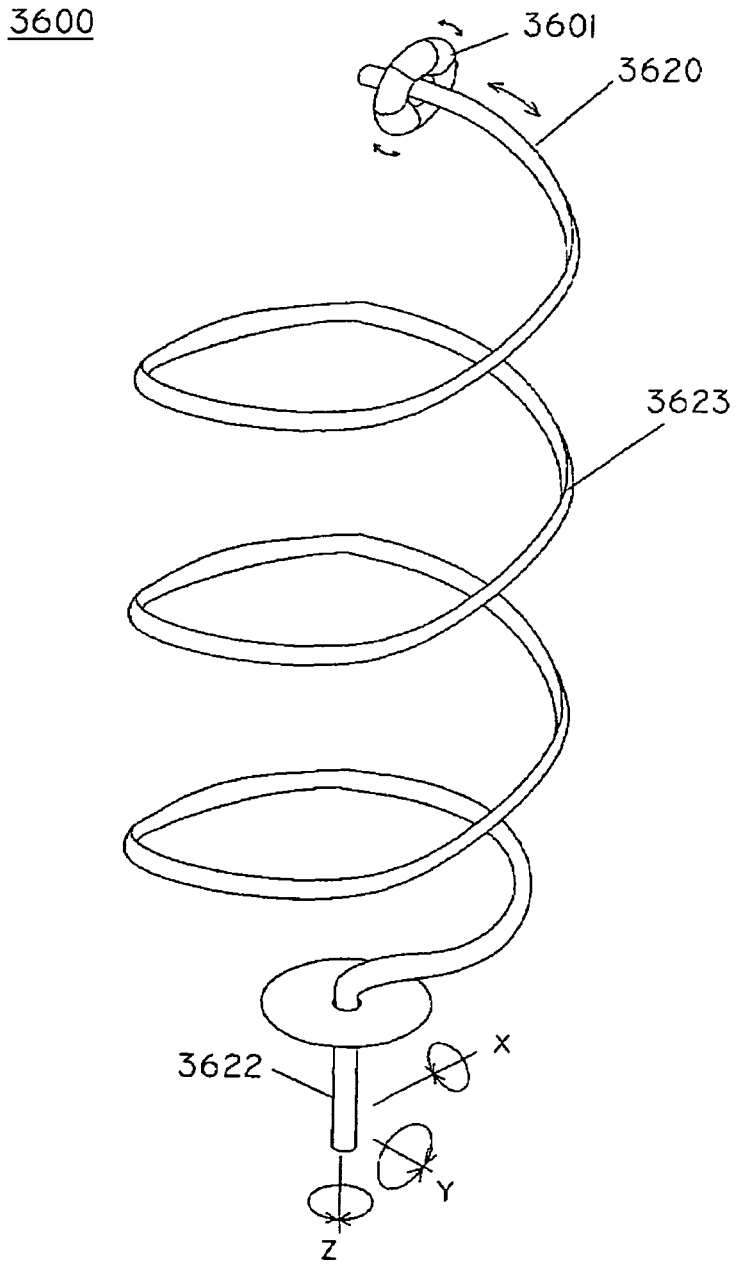
FIG. 36 is a perspective side view of an apparatus in accordance with embodiments of the present system.

FIG. 36 is a perspective side view of an apparatus 3600 in accordance with embodiments of the present system. The apparatus 3600 may include one or more of a link 3620 and an HCS 3601. The HCS 3601 may be similar to the HCS 101. The link 3620 may form a helix having one or more turns 3623 and may include a handle 3622 suitable for grasping by a user. During operation, a user may tilt the link 3620 about one or more axes such as x, y, and z axis so as to cause the HCs 3601 to travel in a desired direction. It is also envisioned that the apparatus 3600 may include a second link shaped similarly to the link 3620 so as to form a double helix.

It may be desirable to open the HCS (e.g., 101, etc.) for various reason such as for untangling and/or to perform conventional activities such as may be performed using a conventional SLINKY™ such as stair walking, etc. Accordingly, the HCS may include a releasable coupling so that it may be opened by a user and for reclosed. For the sake of clarity, an opened HCS will be referred to as a helical open coil spring (HOCS) so that it is not confused with an HCS which may take the form of a torus in a natural state.

Figure 37:
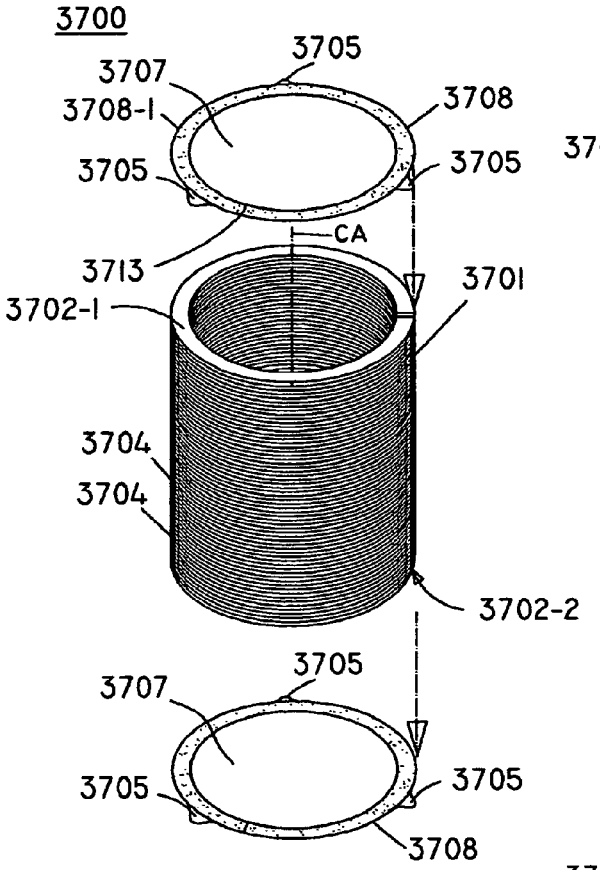
FIG. 37 is a perspective view of a helical open coil spring (HOCS) in a natural open state in accordance with embodiments of the present system.

FIG. 37 is a perspective view of a helical open coil spring (HOCS) 3700 in a natural open state in accordance with embodiments of the present system. The HOCS 3700 may include a helical coil body 3701 having a number of turns 3704 situated between first and second ends 3702-1 and 3702-2 (generally 3702-*x*) and may include a plurality of turns 3704 situated about and defining a center axis (CA) substantially between the ends 3702-1 and 3702-2. A coupler 3708 may included first and second rings 3708-1 and 3708-2, respectively, which may be configured to releasably couple to each other and fixedly couple to the helical coil body 3701. The first and second rings 3708-1 and 3708-2, respectively, may include, for example, a hook-and-loop fasteners (e.g., Velcro™, etc.) and may be coupled to respective ends 3702-1 and 3702-2 of the helical coil body 3701 using a cavity 3711 which receives a portion of one or more turns 3704 at the respective ends 3702-1 and 3702-2 of the helical coil body 3701. However, any suitable method such as adhesives, glues, epoxy, heat bonding, welding, loop type fasteners, staples, threads, etc. is also envisioned for attaching the first and second rings 3708-1 and 3708-2, respectively, to the helical coil body 3701. However, other methods of fastening the first and second rings 3708-1 and 3708-2, respectively, to the respective ends 3702-1 and 3702-2 of the helical coil body 3701 are also envisioned. The first and second rings 3708-1 and 3708-2, respectively, may include tabs 3705 suitable for grasping by a user and which may be pulled by a user to attach of detach the first and second rings 3708-1 and 3708-2, respectively, from each other. By attaching the first and second rings 3708-1 and 3708-2, respectively, to each other, the user may form a torus like spring when in the natural state. Further, the first and second rings 3708-1 and 3708-2, respectively, may include openings such as openings 3707.

Figure 38:
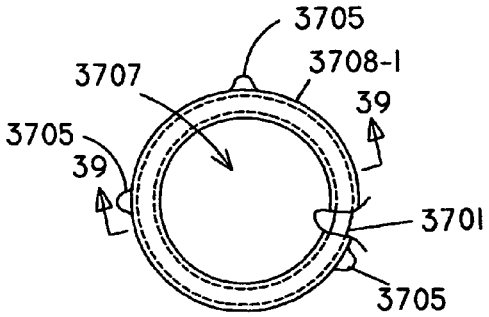
FIG. 38 is a cutaway top view of a portion of the first ring coupled to the helical coil body in accordance with embodiments of the present system.

FIG. 38 is a cutaway top view of a portion of the first ring 3708-1 coupled to the helical coil body 3701 in accordance with embodiments of the present system.

Figure 39:
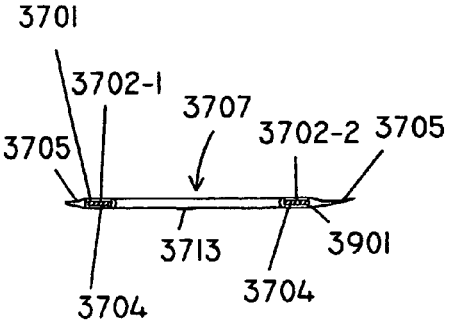
FIG. 39 is a cross sectional view of the first ring taken along lines 39-39 of FIG. 38 in accordance with embodiments of the present system.

FIG. 39 is a cross sectional view of the first ring 3708-1 taken along lines 39-39 of FIG. 38 in accordance with embodiments of the present system. A cavity 3901 is configured to receive one or more turns of the helical coil body 3207 such as the turns 3704 at the ends 3702-2 of the helical coil body 3701. The cavity may include a slit 3713 such that a portion of the turns 3704 may exit from the cavity.

Figure 40:
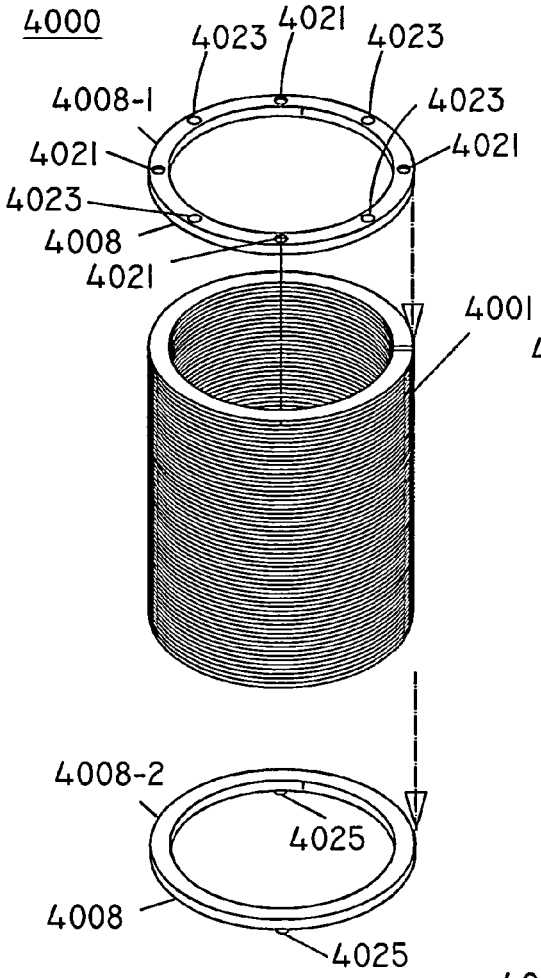
FIG. 40 is a perspective view of a helical open coil spring (HOCS) in a natural open state in accordance with embodiments of the present system.

FIG. 40 is a perspective view of a helical open coil spring (HOCS) 4000 in a natural open state in accordance with embodiments of the present system. The HOCS 4000 may be similar to the HOCS 3700. A coupler 4008 may included first and second coupling rings 4008-1 and 4008-2, respectively, which may be configured to releasably couple to each other and fixedly couple to the helical coil body 4001. The first and second rings 4008-1 and 4008-2, respectively, may include, for example, a Lego™ type male and female friction type fastening system include male portions 4025 and female portions 4021 configured to releaseably couple to each other. Each of the first and second rings 4008-1 and 4008-2, respectively, may include optional magnets 4021 which may magnetically with each other, if desired. The coupling rings 4008-1 and 4008-2, respectively, may be coupled to the helical coil body 3701 using any suitable method such as screws, staples, straps, friction fits, rivets, welding, etc. However, other suitable method such as adhesives, glues, epoxy, heat bonding, etc. is also envisioned.

Figure 41:
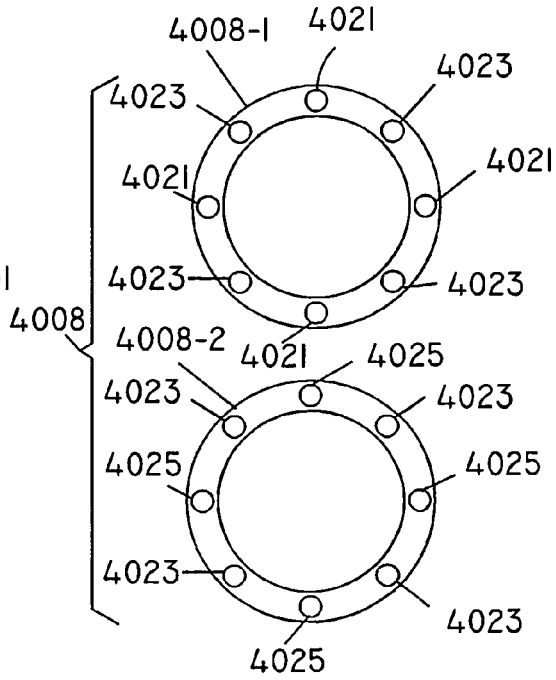
FIG. 41 is a view of adjacent attachment portions of the first and second coupling rings in accordance with embodiments of the present system.

FIG. 41 is a view adjacent attachment portions of the first and second coupling rings 4008-1 and 4008-2 in accordance with embodiments of the present system.

Figure 42:
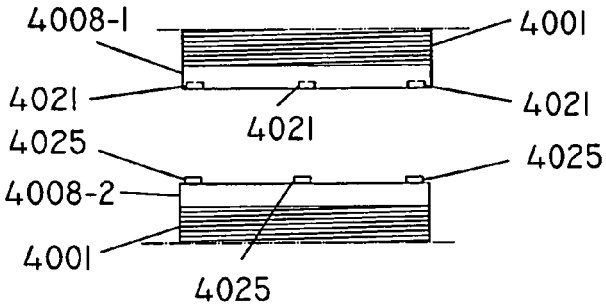
FIG. 42 is a side view of the adjacent attachment portions of the first and second coupling rings in accordance with embodiments of the present system.

FIG. 42 is a side view of the adjacent attachment portions of the first and second coupling rings 4008-1 and 4008-2 in accordance with embodiments of the present system.

Further, in yet other embodiments the rather than using a Lego™-type fastening system a screw type fastening system and/or a camera lens bayonet type mounting methods may be used to releasably couple the first and second coupling rings 4008-1 and 4008-2, respectively, to each other.

In yet other embodiments it is envisioned that an adhesive such as a pressure sensitive adhesive may be used to fixedly couple ends of a helical coil body to each other so as to, for example, form an HCS for use with embodiments of the present system.

Figure 43:
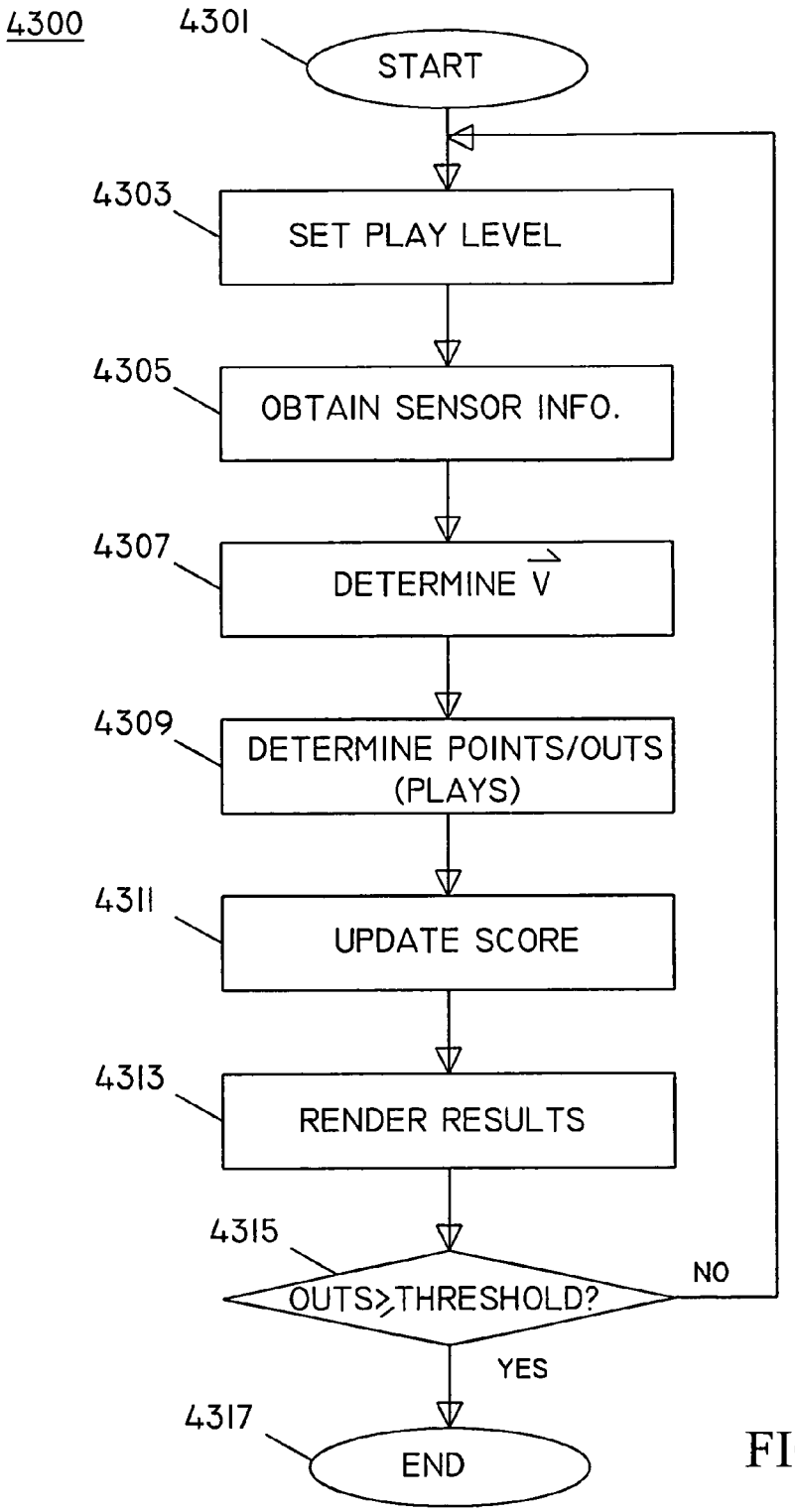
FIG. 43 shows a flow diagram that illustrates a process in accordance with an embodiment of the present system.

FIG. 43 shows a flow diagram that illustrates a process 4300 in accordance with an embodiment of the present system. The process 4300 may be performed using by a system having one or more computers which may communicate over a network. The process 4300 can include one of more of the following acts. Further, one or more of these acts may be combined and/or separated into sub-acts, if desired. In operation, the process may start during act 4301 and then proceed to act 4303.

During act 4303, the process may set a play level. The play level may include information related to an experience level and may include one or more levels such as (e.g., 1=new player, 2=intermediate player, 3=advanced player). The play level may be selected by a user or the system, for example, in accordance with a stored settings for the user acquired from a memory of the system or may be selected based upon default settings, etc. The play level (1, 2, 3) may include information related to corresponding threshold values such as threshold speed value (e.g., 10, 20, 30, respectively, for the play levels 1, 2, and 3.). Further, during this act, the process may reset initial values such as "outs"=0 and score=0, for each player. After completing act 4303, the process may continue to act 4305.

During act 4305, the process may obtain sensor information from sensors of the system. The sensors of the system may sensors such as acceleration sensors which provide acceleration information (e.g., in one or more axis, e.g., to detect change in orientation of the apparatus); gravity sensors which provide orientation information (e.g., to detect orientation, e.g., tilted up, down, etc.), proximity sensors which provide proximity information (e.g., electrical, optical, and/or mechanical, sensors such as an infra-red sensor to detect the presence of the HCS), and/or other sensors as may be discussed elsewhere. For example, in the present embodiment, it will be assumed that the system obtains the proximity information. After completing act 4305, the process may continue to act 4307.

During act 4307, the process may determine velocity (V) (e.g. speed and/or direction of travel of the HCS in, for example, a speed trap (e.g. at the center link) of the apparatus. Accordingly, the process may process the proximity information to determine the velocity of the HCS in the speed trap. The velocity may be used to determine player (e.g. for two player operation). For example, positive velocity through the speed trap may correspond with player one and negative velocity may correspond with player two through the speed trap. After completing act 4307, the process may continue to act 4309.

During act 4309, the process may determine points based using any suitable algorithm(s). The algorithms may be set by the system and/or user and may be stored in a memory of the system for further use. For example in embodiments of the present system, the process may determine points based upon a difference between an absolute value of the velocity and the velocity and the threshold speed value (e.g., obtained during act 4303) for the play level. Thus assuming the play level is 3, then, the threshold speed value is 30. Assuming the absolute value of the velocity is 45, the difference is 45−30=15 and the process may determine the points to be 15 for the determined player (e.g., velocity is positive=player 1). If the difference between the absolute value of the velocity and the threshold speed is negative, this may indicate that the velocity of the HCS is less than the threshold speed and the process may set increase the value of "outs" (e.g., "outs"="outs"+1). After completing act 4309, the process may continue to act 4311.

During act 4311, the process may update the total score. Accordingly, the process may add the score determined during act 4309 to the total score for the corresponding player. For example, if the total score for the first player is 123345, the process may add 15 to this value so that the updated total score is now 123360. After completing act 4311, the process may continue to act 4312.

During act 4312, the process may render results of the process. Accordingly, the process may render the results on, for example, a display of the system and/or a speaker. For example, the display may output the velocity, the total score and the number of "outs." Further, colors may be used to indicate whether the velocity was equal to or above the threshold speed (e.g., green when it is determined that the velocity is equal to or greater than the threshold speed and red when it is determined that the velocity less than the threshold speed). Further, elements of the display may be sequentially lit to indicate the direction of travel of the HCS (e.g., in accordance with the velocity). Moreover, it is envisioned that the system may output audible sounds on a speaker of the system which may be indicative of the speed and/or outs. For example, a first sound file may be output for when it is determined that the velocity is equal to or greater than the threshold speed and a second sound file may be output when it is determined that the velocity less than the threshold speed. The sound files may be selected by the system and/or user. After completing act 4313, the process may continue to act 4315.

During act 4315 the process may determine whether the current value of outs for the corresponding player is equal to or greater than a threshold out value. Accordingly, if it is determined that the current value of outs is equal to or greater than a threshold out value, the process may continue to act 4317 where it ends. However, if it is determined that the current value of outs is less than the threshold out value (e.g., 3), the process may repeat act 4305.

It is also envisioned that embodiments of the present system may include graphics such as may be used for advertising, promotions, etc., upon, for example, the HCS (e.g., the HCS 101, etc.), the links, handles, the displays, etc. Further, it is envisioned that the user may interact with advertising and/or promotional displays which may be rendered on a use interface such as a display of the system.

Figure 44:
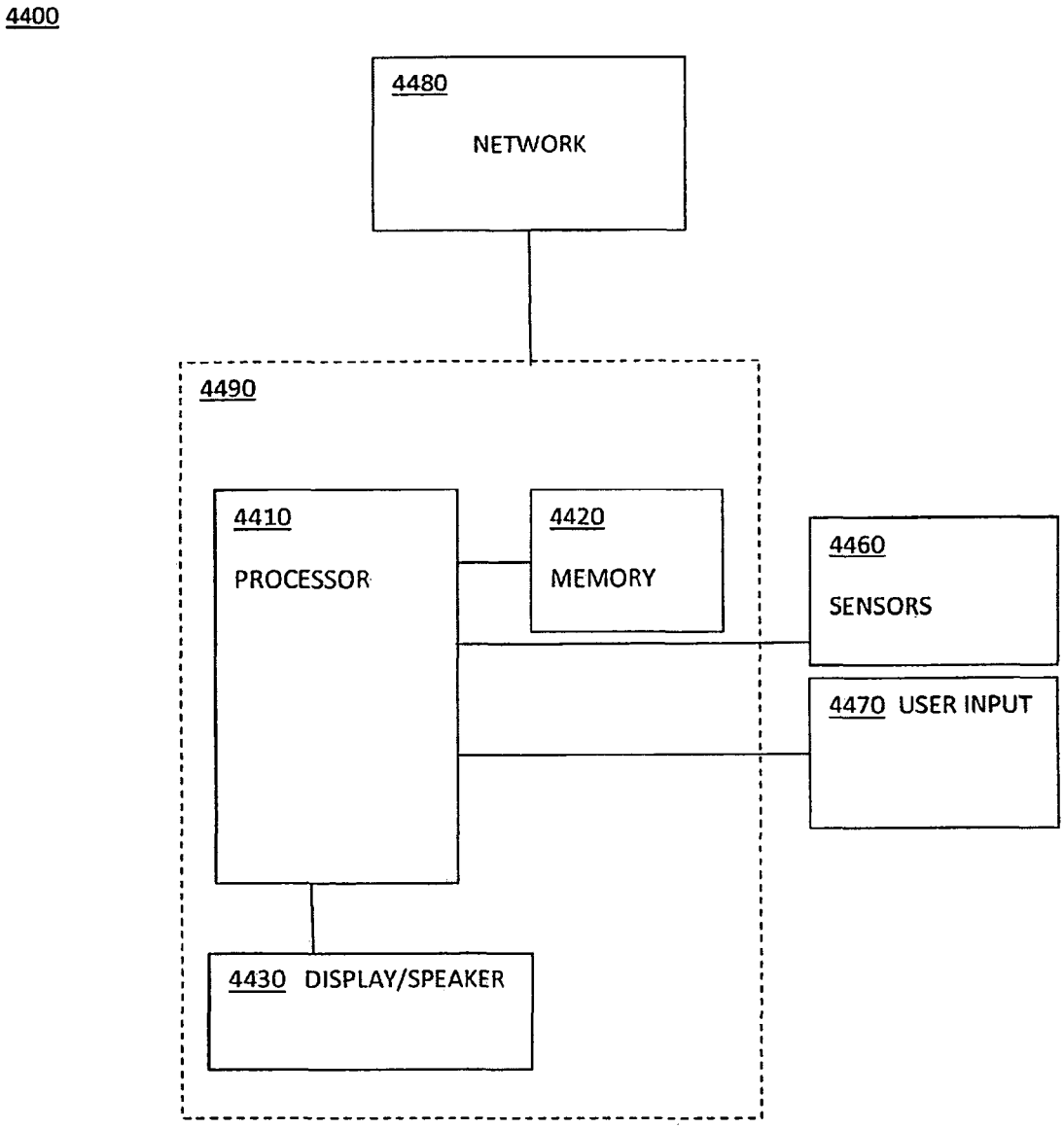
FIG. 44 shows a portion of a system (e.g., peer, server, etc.) in accordance with embodiments of the present system.

FIG. 44 shows a portion of a system 4400 (e.g., peer, server, etc.) in accordance with embodiments of the present system. For example, a portion of the present system may include a processor 4410 operationally coupled to a memory 4420, a display and/or speaker (e.g., a rendering device) 4430, sensors 4460, and a user input device 4470. The memory 4420 may be any type of device for storing application data as well as other data related to the described operation. The application data and other data are received by the processor 4410 for configuring (e.g., programming) the processor 4410 to perform operation acts in accordance with the present system. The processor 4410 so configured becomes a special purpose machine particularly suited for performing in accordance with the present system.

The operation acts may include requesting, providing, and/or rendering of content. The user input 4470 may include a keyboard, keys (hard or soft), a mouse, trackball or other device, including touch sensitive displays, which may be stand alone or be a part of a system, such as part of a personal computer, personal digital assistant, mobile phone, set top box, television or other device for communicating with the processor 4410 via any operable link. The user input device 4470 may be operable for interacting with the processor 4410 including enabling interaction within a UI as described herein. Clearly the processor 4410, the memory 4420, display 4430 and/or user input device 4470 may all or partly be a portion of a computer system or other device such as a client and/or server as described herein.

The methods of the present system are particularly suited to be carried out by a computer software program, such program containing modules corresponding to one or more of the individual steps or acts described and/or envisioned by the present system. Such program may of course be embodied in a computer-readable medium, such as an integrated chip, a peripheral device or memory, such as the memory 4420 or other memory coupled to the processor 4410.

The program and/or program portions contained in the memory 4420 configure the processor 4410 to implement the methods, operational acts, and functions disclosed herein. The memories may be distributed, for example between the clients and/or servers, or local, and the processor 4410, where additional processors may be provided, may also be distributed or may be singular. The memories may be implemented as electrical, magnetic or optical memory, or any combination of these or other types of storage devices. Moreover, the term "memory" should be construed broadly enough to encompass any information able to be read from or written to an address in an addressable space accessible by the processor 4410. With this definition, information accessible through a network is still within the memory, for instance, because the processor 4410 may retrieve the information from the network for operation in accordance with the present system.

The processor 4410 is operable for providing control signals and/or performing operations in response to input signals from the user input device 4470, the sensors 4460, as well as in response to other devices of a network and executing instructions stored in the memory 4420. The processor 4410 may be an application-specific or general-use integrated circuit(s). Further, the processor 4410 may be a dedicated processor for performing in accordance with the present system or may be a general-purpose processor wherein only one of many functions operates for performing in accordance with the present system. The processor 4410 may operate utilizing a program portion, multiple program segments, or may be a hardware device utilizing a dedicated or multi-purpose integrated circuit.

Further variations of the present system would readily occur to a person of ordinary skill in the art and are encompassed by the following claims. Through operation of the present system, a virtual environment solicitation is provided to a user to enable simple immersion into a virtual environment and its objects.

Finally, the above-discussion is intended to be merely illustrative of the present system and should not be construed as limiting the appended claims to any particular embodiment or group of embodiments. Thus, while the present system has been described with reference to exemplary embodiments, it should also be appreciated that numerous modifications and alternative embodiments may be devised by those having ordinary skill in the art without departing from the broader and intended spirit and scope of the present system as set forth in the claims that follow. In addition, the section headings included herein are intended to facilitate a review but are not intended to limit the scope of the present system. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise;

h) no specific sequence of acts or steps is intended to be required unless specifically indicated; and i) the term "plurality of" an element includes two or more of the claimed element, and does not imply any particular range of number of elements; that is, a plurality of elements may be as few as two elements, and may include an immeasurable number of elements.

What is disclosed is:

1. A toy comprising:

a plurality of rods each having a length;

a helical spring coil having first and second ends and a plurality of turns (T) situated about and defining a center axis between the first and second ends of the helical coil spring; and a coupler which couples the first and second ends of the helical spring coil to each other so as to form a center opening configured to receive the plurality of rods, wherein an outer surface of one or more of the plurality of turns is in contact with the plurality of rods and rotates in a substantially poloidal direction about the central axis when traveling axially along the plurality of rods, wherein the plurality of rods are hingedly adjustable relative to each other to selectively stretch the helical spring coil along the center axis so as to change the shape or size of the center opening from a shape and size of the center opening in a relaxed closed state.

2. The toy of claim 1, wherein the coupler couples the first and second ends of the helical coil spring together so that the helical coil spring forms a torus-like shape in a relaxed closed state.

3. The toy of claim 1, wherein the coupler comprises one or more of an adhesive, a hook-and-loop fastener, a friction-type fastener, and a magnetic fastener.

4. The toy of claim 1, wherein at least one of the plurality of rods has a variable cross-section or a constant cross section, the variable cross-section configured to stretch the helical spring coil as the helical spring coil travels axially along a length of the at least one rod.

5. The toy of claim 1, wherein the helical spring coil is configured to travel axially along at least one rod of the plurality of rods in accordance with one or more of an inclination and tilt of the corresponding at least one rod.

6. The toy of claim 1, further comprising a hinge which couples the plurality of rods.

7. The toy of claim 1, further comprising one or more restrainers configured to limit the separation of portions of the plurality of rods from each other.

8. The toy of claim 1, wherein the distance between portions of the plurality of rods is adjustable so as to form an inclined plane.

9. The toy of claim 1, wherein at least one of the plurality of rods further comprises at least one handle suitable for grasping by a user or one or more bends situated along a length thereof.

10. A toy comprising:

a plurality of rods each having a length:

a helical spring coil having first and second ends and a plurality of turns (T) situated about and defining a center axis between the first and second ends of the helical coil spring:

a coupler which couples the first and second ends of the helical spring coil to each other so as to form a center opening configured to receive the plurality of rods, wherein an outer surface of one or more of the plurality of turns is in contact with the plurality of rods and rotates in a substantially poloidal direction about the central axis when traveling axially along the plurality of rods:

a display; and a controller which determines one or more of a location, speed, and direction of the helical coil spring, determines a score in accordance with the determination, and renders the score on the display.

11. A toy comprising:

a helical spring coil having first and second ends and a plurality of turns turned about and defining a center axis between first and second ends of the helical coil spring, the helical spring coil bent substantially in a closed axial circle by a coupler so as to define a center opening for receiving at least one rod, wherein the helical spring coil is configured to rotate in a modified poloidal direction (θ) about the central axis when traveling axially along the at least one rod, wherein the helical spring coil further comprises one or more light sources coupled to one or more of the plurality of turns.

12. The toy of claim 11, wherein the at least one rod comprises one or more of a stick, a pole, a cone, a baton, a cylinder, a bottle, a pipe, a track, a tube, a hose, a rope, and a rail.

13. The toy of claim 12, wherein the at least one rod further comprises one or more of a turn, a twist, and a knot along a length thereof.

14. The toy of claim 11, wherein the helical spring coil further comprises a controller electronically coupled to the one or more light sources and which controls the operation of the one or more light sources to form desired text or graphics.

15. The toy of claim 14, further wherein the controller controls the operation of the one or more light sources in accordance with one or more of time, acceleration in one or more axes, a value of (θ), a change of (θ) over time, a position of the helical spring coil relative to a toroidal axis (ϕ), a change in (ϕ) over time, and a location of the a helical spring coil relative to the at least one rod.

16. The toy of claim 14, further comprising a speaker electronically coupled to the controller and which outputs an audible signal output by the controller.

17. The toy of claim 16, wherein the controller determines a position of the helical spring coil relative to the at least one rod and outputs an audio signal based upon the determined position.

18. The toy of claim 11, further comprising a second helical spring coil having first and second ends and a plurality of turns turned about and defining a center axis between the first and second ends of the second helical coil spring, the second helical spring coil bent substantially in a closed axial circle by a coupler so as to define a center opening for receiving the guide member, wherein the second helical spring coil is configured to rotate in a poloidal direction (θ) about the central axis when traveling axially along the at least one rod.

19. The toy of claim 11, wherein the at least one rod further comprises first and second ends situated apart from each other to define a path therebetween for the helical spring coil to travel axially along.

20. The toy of claim 11, wherein at least one of the plurality of turns of the helical spring coil has a cross section with at least one substantially flat side.

21. A toy comprising:

a guide comprising a plurality of rods movably coupled to each other;

a helical spring coil having first and second ends and a plurality of turns (T) situated about and defining a center axis between the first and second ends of the helical spring coil; and a coupler which couples the first and second ends of the helical spring coil to each other so as to form a center opening configured to receive the plurality of links, wherein an outer surface of one or more of the plurality of turns is in contact with the plurality of links rods so that the helical spring coil rotates in a substantially poloidal direction about the central axis when traveling axially along the guide.

* * * * *